US005147752A

United States Patent [19]

Kato et al.

[11] Patent Number: 5,147,752

[45] Date of Patent: Sep. 15, 1992

[54] PROCESS FOR PRODUCING ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 607,328

[22] Filed: Oct. 30, 1990

[30] Foreign Application Priority Data

Oct. 31, 1989 [JP] Japan ..... 1-282029
Jan. 25, 1990 [JP] Japan ..... 2-13739

[51] Int. Cl.[5] ..... G03G 5/05
[52] U.S. Cl. ..... 430/134; 430/96
[58] Field of Search ..... 430/96, 49, 134

[56] References Cited

U.S. PATENT DOCUMENTS 4,952,475 8/1990 Kato et al. ..... 430/96
4,968,572 11/1990 Kato et al. ..... 430/96
5,009,975 4/1991 Kato et al. ..... 430/96

*Primary Examiner*—John Goodrow

*Attorney, Agent, or Firm*—Sughrue, Mion, Zinn, Macpeak & Seas

[57] ABSTRACT

A process for producing an electrophotographic light-sensitive material comprising a support having provided thereon a photoconductive layer containing an inorganic photoconductive substance and a binder resin is disclosed. The method comprises mixing the inorganic photoconductive substance and the binder resin to prepare a dispersion for forming the photoconductive layer, and coating the dispersion on the support, wherein the binder resin contains at least one resin (A) which has a weight average molecular weight of from $1\times10^3$ to $1\times10^4$ contains a repeating unit represented by the formula (I) specified above as a polymer component, has a crosslinked structure prior to the preparation of the dispersion for forming the photoconductive layer, and has at least one acidic group bonded at only one terminal of at least one polymer main chain. The electrophotographic light-sensitive material obtained according to the present invention is excellent in electrostatic characteristics and anti-humidity.

13 Claims, No Drawings

PROCESS FOR PRODUCING ELECTROPHOTOGRAPHIC LIGHT-SENSITIVE MATERIAL

FIELD OF THE INVENTION

The present invention relates to a process for producing an electrophotographic light-sensitive material, and more particularly to a process for producing an electrophotographic light-sensitive material which is excellent in electrostatic characteristics and moisture resistance.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. In particular, a direct electrophotographic lithographic plate has recently become important as a system for printing in the order of from several hundreds to several thousands of prints having a high image quality.

Binders which are used for forming the photoconductive layer of an electrophotographic light-sensitive material are required to be excellent in the film-forming properties by themselves and to possess the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue before light-exposure and also have an excellent image forming properties, and the photoconductive layer stably maintains these electrostatic properties to change of humidity at the time of image formation.

Further, extensive studies have been made for lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

However, conventional binder resins used for electrophotographic light-sensitive materials have various problems particularly in electrostatic characteristics such as charging property, dark charge retention, light sensitivity, etc., and smoothness of the photoconductive layer.

In order to overcome the above problems, JP-A-63-2173 and JP-A-1-70761 (the term "JP-A" as used herein means an "unexamined Japanese patent application") disclose improvements in the smoothness of the photoconductive layer and electrostatic characteristics by using, as a binder resin, a resin having a low molecular weight containing from 0.05 to 10% by weight of a copolymer component containing an acidic group in side chains of the polymer or a resin having a low molecular weight (i.e., a weight average molecular weight (Mw) of from $1\times10^3$ to $1\times10^4$) having an acidic group bonded at the terminal of the polymer main chain thereby obtaining an image having no background stains. Also, JP-A-1-100554 and JP-A-1-214865 disclose a technique using, as a binder resin, a resin containing a polymer component containing an acidic group in side chains of the copolymer or at the terminal of the polymer main chain, and containing a polymer component having a heat- and/or photo-curable functional groups; JP-A-1-102573 and JP-A-2-874 disclose a technique using a resin containing an acidic group in side chains of the copolymer or at the terminal of the polymer main chain, and a crosslinking agent in combination; JP-A-64-564, JP-A-63-220149, JP-A-63-220148, JP-A-1-280761, JP-A-1-116643 and JP-A-1-169455 disclose a technique using a resin having a low molecular weight (a weight average molecular weight of from $1\times10^3$ to $1\times10^4$) and a resin having a high molecular weight (a weight average molecular weight of $1\times10^4$ or more) in combination; and JP-A-2-34859 discloses a technique using the above low molecular weight resin and a heat- and/or photo-curable resin in combination. The above prior art references disclose that, according to the proposed technique, the film strength of the photoconductive layer can be increased sufficiently and also the mechanical strength of the photosensitive material can be increased without adversely affecting the above-described electrostatic characteristics by using a resin containing an acidic group in side chains or at the terminal of the polymer main chain.

However, it has been found that, even in the case of using these resins, it is yet insufficient to keep the stable performance in the case of greatly changing the environmental conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

Further, when the scanning exposure system using a semiconductor laser beam is applied to hitherto known light-sensitive materials for electrophotographic lithographic printing master plates, various problems may occur in that the difference between $E_{\frac{1}{2}}$ and $E_{1/10}$ is particularly large and the contrast of the reproduced image is decreased. Thus, it is difficult to reduce the remaining potential after exposure, which results in severe fog formation in duplicated images, and when employed as offset masters, edge marks of originals pasted up appear on the prints, in addition to the insufficient electrostatic characteristics described above.

SUMMARY OF THE INVENTION

The present invention has been made for solving the problems of conventional electrophotographic light-sensitive materials as described above and meeting the requirement for the light-sensitive materials.

An object of the present invention is to provide a process for producing an electrophotographic light-sensitive material having stable and excellent electrostatic characteristics and giving clear good images even when the environmental conditions during the formation of duplicated images are changed to a low-temperature and low-humidity or to high-temperature and high-humidity.

Another object of the present invention is to provide a process for producing a CPC electrophotographic light-sensitive material having excellent electrostatic characteristics and showing less environmental dependency.

A further object of the present invention is to provide a process for producing an electrophotographic light-sensitive material effective for a scanning exposure system using a semiconductor laser beam.

A still further object of this invention is to provide a process for producing an electrophotographic lithographic printing master plate having excellent electrostatic characteristics (in particular, dark charge retentivity and photosensitivity), capable of reproducing faithful duplicated images to original, forming neither overall background stains nor dotted background stains of prints, and showing excellent printing durability.

Other objects of the present invention will become apparent from the following description and examples.

It has been found that the above described objects of the present invention are accomplished by a process for producing an electrophotographic light-sensitive material comprising a support having provided thereon a photoconductive layer containing an inorganic photoconductive substance and a binder resin, which comprises mixing the inorganic photoconductive substance and the binder resin to prepare a dispersion for forming a photoconductive layer, and coating the dispersion on the support, wherein said binder resin contains at least a resin (A) having a weight average molecular weight of from about $1\times10^3$ to about $1\times10^4$, containing a repeating unit represented by formula (I) shown below as a polymer component of said resin, having a crosslinked structure prior to the preparation of said dispersion for forming a photoconductive layer, and having at least one acidic group selected from the group consisting of a $-PO_3H_2$ group, a $-SO_3H$ group, a $-COOH$ group, a

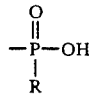

group (wherein R represents a hydrocarbon group or a —OR′ group (wherein R′ represents a hydrocarbon group)) and a cyclic acid anhydride-containing group bonded to only one terminal of the polymer main chain of said binder:

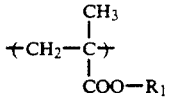

(I)

wherein $R_1$ represents a hydrocarbon group.

DETAILED DESCRIPTION OF THE INVENTION

The characteristic feature of the electrophotographic light-sensitive material of the present invention resides in that the resin (A) contained in the binder resin previously has a crosslinked structure prior to the preparation of a dispersion of a photoconductive substance for forming a photoconductive layer. That is, as a property of the resin (A) per se used for a binder resin, the polymer thereof is at least partially crosslinked, differing from the crosslinked structure which can be formed in the binder resin after preparation of the dispersion, e.g., in a coating step on a support, a subsequent drying step, etc. of the dispersion.

According to the present invention, it was found that remarkable improvements can be obtained in electrostatic characteristics (in particular, electrostatic characteristics under severe conditions) and moisture resistance property by using, as a binder resin, a lower molecular weight resin having a previously crosslinked structure and an acidic group bonded to the terminal, as compared with a resin having no crosslinked structure or a resin wherein the crosslinked structure is formed after preparation of the dispersion. The difference in the property is considered to occur in dispersing the photoconductive substance in a binder resin, i.e., when the binder resin and the photoconductive substance are mutually reacted. That is, it is considered that the control of the interaction between the photoconductive substance and the binder resin during the dispersion according to the present invention is very effective, and the electrophotographic performance obtained after film formation varies widely depending upon the above control.

The partially crosslinked structure in the resin (A) can be formed by polymerizing a monomer corresponding to the copolymer component represented by formula (I) above and a polyfunctional monomer containing at least two polymerizable functional groups which are copolymerizable with the above monomer in an amount of not more than about 20% by weight, preferably from 1.0 to 10% by weight, based on the total monomers while appropriately adjusting the polymerization condition so as to form the crosslinked structure.

The use of the polyfunctional monomer in an amount exceeding 20% by weight based on the total monomers is not preferred due to the decrease in the solubility of the resulting resin in an organic solvent.

The formation of the crosslinked structure by intermolecular bonding such as by condensation reaction, addition reaction, etc. sometimes may cause deterioration in electrostatic properties of the resulting electrophotographic light-sensitive material, whereas, the crosslinked structure obtained by the above polymerization is preferred since the electrophotographic light-sensitive material obtained therefrom does not show such deterioration in the electrostatic characteristics.

Specific examples of the polymerizable functional group are $CH_2{=}CH-$, $CH_2{=}CH-CH_2-$,

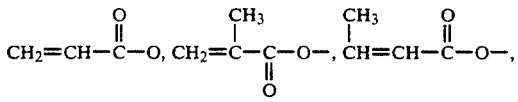

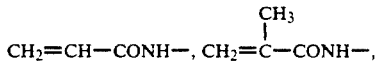

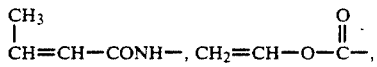

-continued $$CH_2{=}\overset{\overset{\displaystyle CH_3}{|}}{C}{-}O{-}\overset{\overset{\displaystyle O}{\|}}{C}{-},\ CH_2{=}CH{-}CH_2{-}O{-}\overset{\overset{\displaystyle O}{\|}}{C}{-},$$

$CH_2{=}CH{-}NHCO{-}$, $CH_2{=}CH{-}CH_2NHCO{-}$, $CH_2{=}CH{-}SO_2{-}$, $CH_2{=}CH{-}CO{-}$, $CH_2{=}CH{-}O{-}$, and $CH_2CH{-}S{-}$. The monomer having at least two polymerizable functional groups can be those having the same or different functional groups described above.

Specific examples of the monomer having at least two polymerizable functional groups include monomers having the same polymerizable functional groups, for example, styrene derivatives such as divinylbenzne, trivinylbenzene, etc.; esters of methacrylic acid, acrylic acid or crotonic acid of a polyhydric alcohol (e.g., ethylene glycol, diethylene glycol, triethylene glycol, polyethylene glycols #200, #400, #600, 1,3-butylene glycol, neopentyl glycol, dipropylene glycol, polypropylene glycol, trimethylol propane, trimethylol ethane, pentaerythritol) or a polyhydroxyphenol (e.g., hydroquinone, resorcine, catechol and derivatives thereof), vinyl ethers or allyl ethers; vinyl esters, allyl esters, vinylamides or allylamides of dibasic acids (e.g., malonic acid, succinic acid, glutaric acid, adipic acid, pimelic acid, maleic acid, phthalic acid, itaconic acid); condensates of polyamines (e.g., ethylenediamine, 1,3-propylenediamine, 1,4-butylenediamine) and carboxylic acids containing a vinyl group (e.g., methacrylic acid, acrylic acid, crotonic acid, allylacetic acid). Specific examples of monomers having different polymerizable functional groups include vinyl group-containing ester derivatives and amide derivatives of vinyl group-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, a reaction product between a carboxylic acid anhydride and an alcohol or an amine (e.g., allyloxycarbonylpropionic acid, allyloxycarbonylacetic acid, 2-allyloxycarbonylbenzoic acid, allylaminocarbonylpropionic acid)), for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, methacrylic acid vinyloxycarbonylmethyl ester, acrylic acid vinyloxycarbonylmethyloxycarbonylethylene ester, N-allylacrylamide, N-allylmethacrylamide, N-allylitaconic acid amide, methacryloylpropionic acid allylamide), or condensates of aminoalcohols (e.g., aiinoethanol, 1-aminopropanol, 1-aminobutanol, 1-aminohexanol, 2-aminobutanol) and vinyl group-containing carboxylic acids.

As described above, the resin (A) of the present invention is characterized by having a crosslinked structure in at least a part of the polymer, and also the resin (A) should be soluble in an organic solvent used for preparing a dispersion containing at least the inorganic photoconductive substance and the binder resin for forming a photoconductive layer. More specifically, for example, a resin (A) having a solubility of at least 5 parts by weight in 100 parts by weight of toluene at a temperature of 25° C. can be used. Examples of solvents which can be used for preparing a coating dispersion include halogenated hydrocarbons such as dichloromethane, dichloroethane, chloroform, methylchloroform and trichlene, alcohols such as methanol, ethanol, propanol and butanol, ketones such as acetone, methyl ethyl ketone and cyclohexanone, ethers such as tetrahydrofuran and dioxane, esters such as methyl acetate, ethyl acetate, propyl acetate, butyl acetate and methyl propionate, glycol ethers such as ethylene glycol monomethyl ether and 2-methoxyethyl acetate, aromatic hydrocarbons such as benzene, toluene, xylene and chlorobenzene, which can be used alone or a mixture thereof. The weight average molecular weight of the resin (A) is from about $1\times10^3$ to about $1\times10^4$, preferably from $3\times10^3$ to $9\times10^3$.

If the molecular weight of the resin (A) is less than about $1\times10^3$, the film-forming property is reduced and a sufficient film strength is not maintained, whereas, if the molecular weight is higher than about $1\times10^4$, the electrophotographic characteristics (in particular, initial potential and dark decay retentivity) using such a resin are undesirably reduced. The glass transition point of the resin (A) is preferably from −10° C. to 100° C., and more preferably from 5° C. to 95° C.

The content of the copolymer component corresponding to the repeating unit of formula (I) in the polymer is preferably 30% by weight or more, more preferably from 50 to 99% by weight.

The repeating unit represented by formula (I) is described hereinafter in detail.

In the repeating unit represented by formula (I), $R_1$ represents a hydrocarbon group which may be substituted, preferably a hydrocarbon group having from 1 to 18 carbon atoms which may be substituted. The substituent can be any group other than the above-described acidic group bonded to only one terminal of the polymer main chain, and examples of the substituents include a halogen atom (e.g., fluorine, chlorine and bromine atoms), $-O-R_2$, $-COO-R_2$, and $-OCO-R_2$ (wherein $R_2$ represents an alkyl group having from 1 to 22 carbon atoms, e.g., methyl, ethyl, propyl, butyl, hexyl, octyl, decyl, dodecyl, hexadecyl and octadecyl groups. Preferred hydrocarbon groups include an alkyl group having from 1 to 18 carbon atoms, which may be substituted (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl groups), an alkenyl group having from 4 to 18 carbon atoms, which may be substituted (e.g., 2-methyl-1-porpenyl, 2-butenyl, 2-pentenyl, 3-methyl-2-pentenyl, 1-pentenyl, 1-hexenyl, 2-hexenyl, and 4-methyl-2-hexcenyl groups), an aralkyl group having from 7 to 12 carbon atoms, which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl groups), an alicyclic group having from 5 to 8 carbon atoms, which may be substituted (e.g., cyclohexyl, 2-cyclohexylethyl, and 2-cyclopentylethyl groups), and an aromatic group having from 6 to 12 carbon atoms, which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl groups).

In the hydrocarbon groups represented by $R_1$, when $R_1$ represents an aliphatic group, a repeating unit having a hydrocarbon group having from 1 to 5 carbon atoms is preferably contained in an amount of at least 60% by weight in the total units represented by formula (I).

The repeating unit represented by formula (I) is preferably represented by the following formula (Ia) and/or (Ib):

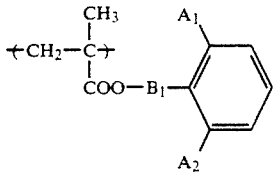

(Ia)

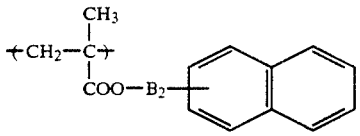

(Ib)

wherein $A_1$ and $A_2$, which may be the same or different, each represents a hydrogen atom, a hydrocarbon group having from 1 to 10 carbon atoms, a chlorine atom, a bromine atom, —$COR_3$ or —$COOR_3$, wherein $R_3$ represents a hydrocarbon group having from 1 to 10 carbon atoms, and $B_1$ and $B_2$ each represents a single bond or a linkage group having 1 to 4 linking atoms connecting between —COO— and the benzene ring.

It has been found that, when the resin (A) contains a methacrylate component having a specific substituent represented by the above formula (Ia) and/or (Ib), the electrophotographic properties (in particular, $V_{10}$, D.R.R., and $E_{1/10}$) are improved and are particularly effective to a light-sensitive material for a scanning exposure system using a semiconductor laser beam. Although the reason therefor is not understood, it is considered that polymer molecular chains are suitably arranged in boundary surfaces between photoconductive particles (e.g., zinc oxide) in the light-sensitive layer by the effect of a planner benzene ring having a substituent at the orth-position or a naphthalene ring.

In formula (Ia), $A_1$ and $A_2$ each preferably represents a hydrogen atom, a chlorine atom, a bromine atom, an alkyl group having up to 4 carbon atoms (e.g., methyl, ethyl, propyl, and butyl groups), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl groups), an aryl group (e.g., phenyl, tolyl, xylyl, bromophenyl, methoxyphenyl, chlorophenyl, and dichlorophenyl), or —$COR_4$ or —$COOR_4$, wherein $R_4$ preferably represents any of the above-recited hydrocarbon groups.

In formula (Ia), $B_1$ is a bond or a linkage group containing 1 to 4 linking atoms which connects between —COO— and the benzene ring e.g., $$\text{-}(CH_2)_a\text{-}\ (a: 1, 2 \text{ or } 3),\ \text{-}CH_2CH_2OCO\text{-},$$

$$\text{-}(CH_2O)_b\text{-}\ (b: 1 \text{ or } 2),$$

and —$CH_2CH_2O$—.

In formula (Ib), $B_2$ has the same meaning as $B_1$.

Specific examples of repeating units represented by formula (Ia) or (Ib) which are preferably used in the present invention are shown below for illustrative purposes, but the present invention is not to be construed as being limited thereto.

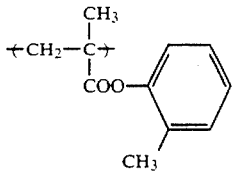

i-1)

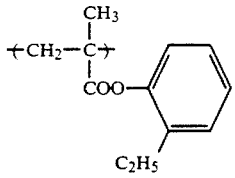

i-2)

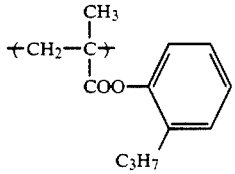

i-3)

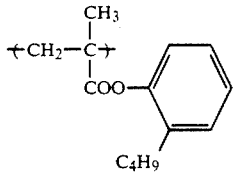

i-4)

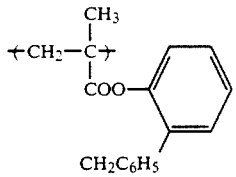

i-5)

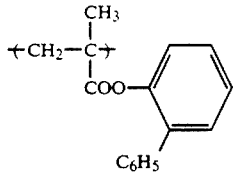

i-6)

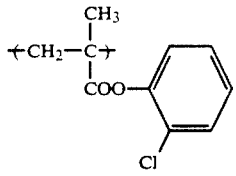

i-7)

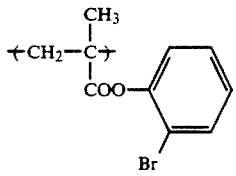

i-8)

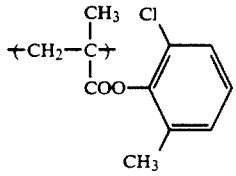

i-9)

-continued
i-10)
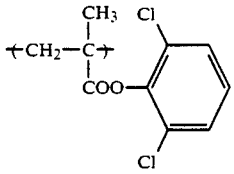
i-11)
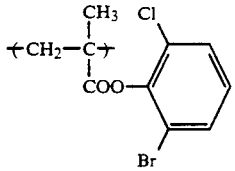
i-12)
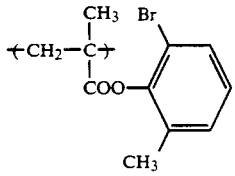
i-13)
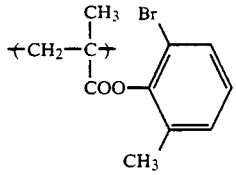
i-14)
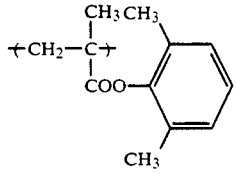
i-15)
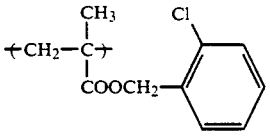
i-16)
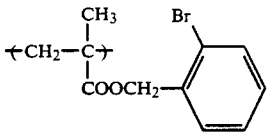
i-17)
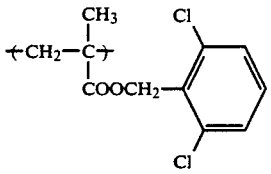
i-18)
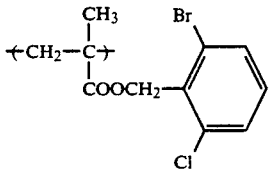
-continued
i-19)
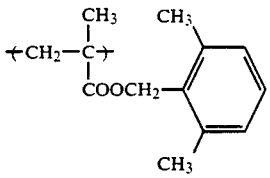
i-20)
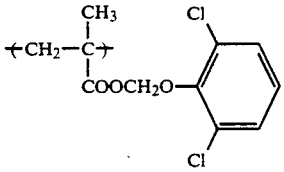
i-21)
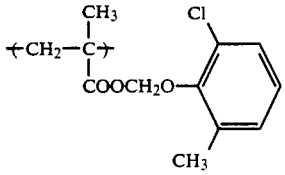
i-22)
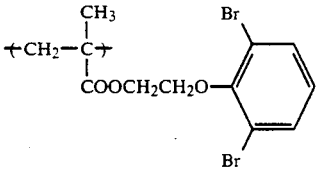
i-23)
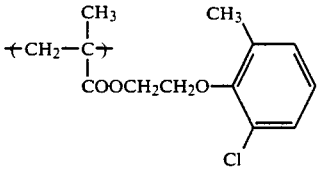
i-24)
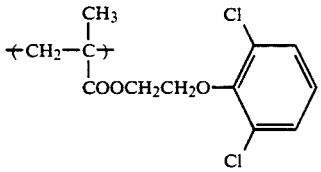
i-25)
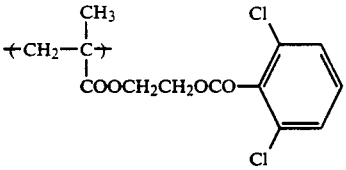
i-26)
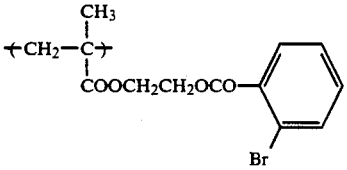
i-27)
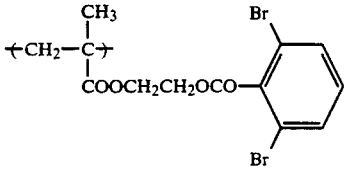

-continued i-28)

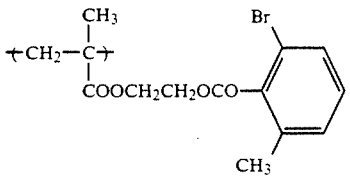

i-29)

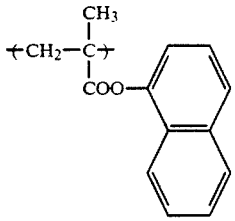

i-30)

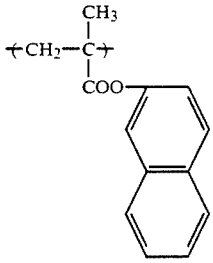

i-31)

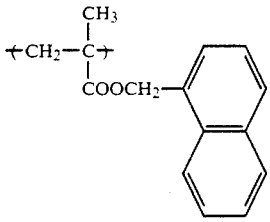

i-32)

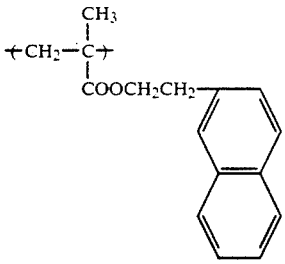

i-33)

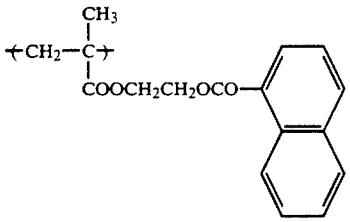

i-34)

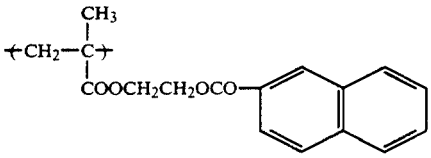

-continued i-35)

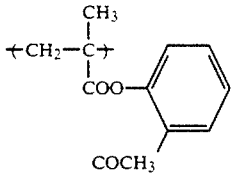

i-36)

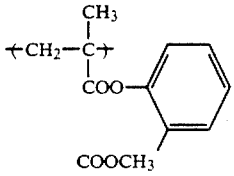

i-37)

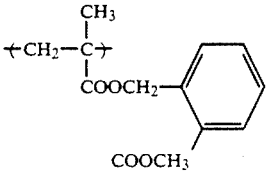

i-38)

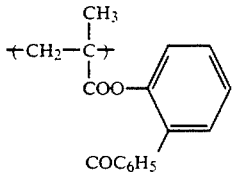

i-39)

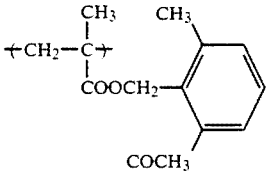

i-40)

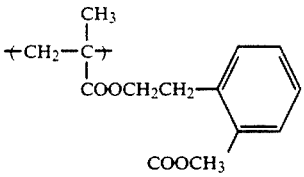

Further, the resin (A) of the present invention preferably contains a functional group capable of curing the resin by the action of at least one of heat and light, i.e., a heat- and/or photo-curable functional group. That is, it is preferred that the resin (A) used in the present invention contains a copolymer component containing a heat- and/or photo-curable functional group, in addition to the functional copolymer component for forming a crosslinked structure in the resin (A) and the copolymer component corresponding to formula (I) (including formulae (Ia) and (Ib)), in order to improve the film strength and thereby to increase the mechanical strength of the electrophotographic light-sensitive material.

The proportion of the above-described copolymer component containing a heat- and/or photo-curable functional group in the resin (A) of the present invention is preferably from 1 to 30% by weight, more preferably 5 to 30% by weight. When the proportion is less than 1% by weight, any appreciable effect on improvement in the film strength of the photoconductive layer is not obtained due to insufficient curing reaction. On the other hand, when the proportion exceeds 30% by weight, excellent electrophotographic properties are difficult to retain even by the resin (A) of the present invention and are decreased to the same degree as those obtained by conventional resin binders. Also, the offset master produced from the resin (A) containing more than 30% by weight of the heat- and/or photo-curable functional group suffers from increased background stains in the non-image area in prints.

Specific examples of light-curable functional group are those used in conventional photosensitive resins known as photocurable resins as described in Hideo Inui and Gentaro Nagamatsu, *Kankosei Kobunshi*, Kodansha (1977), Takahiro Tsunoda, *Shin-Kankosei Jushi*, Insatsu Gakkai Shuppanbu (1981), G.E. Green and B.P. Strak, *J. Macro. Sci. Reas. Macro. Chem.*, C 21(2), pp. 187-273 (1981-1982), and C.G. Rattey, *Photopolymerization of Surface Coatings*, A Wiley Interscience Pub. (1982).

The heat-curable functional group includes functional groups excluding the above-specified acidic groups. Examples of the heat-curing functional groups are described, e.g., Tsuyoshi Endo, *Netsukokasei Kobunshi no Seimitsuka*, C.M.C. (1986), Yuji Harasaki, *Saishin Binder Gijutsu Binran*, Ch. II-I, Sogo Gijutsu Center (1985), Takayuki Ohtsu, *Acryl Jushi no Gosei Sekkei to Shin-Yoto*, Chubu Kei-ei Kaihatsu Center Shuppanbu (1985), and Eizo Ohmori, *Kinosei Acryl Jushi*, Techno System (1985).

Specific examples of curing functional groups are —OH, —SH, —$NH_2$ —$NHR_5$ (wherein $R_5$ represents a hydrocarbon group, such as an alkyl group which may be substituted (e.g., methyl, ethyl, propyl, butyl, hexyl, octyl, decyl, 2-chloroethyl, 2-methoxyethyl, and 2-cyanoethyl group), a cycloalkyl group having from 4 to 8 carbon atoms which may be substituted (e.g., cycloheptyl and cyclohexyl groups), an aralkyl group having from 7 to 12 carbon atoms which may be substituted (e.g., benzyl, phenethyl, 3-phenylpropyl, chlorobenzyl, methylbenzyl, and methoxybenzyl groups) and an aryl group which may be substituted (e.g., phenyl, tolyl, xylyl, chlorophenyl, bromophenyl, methoxyphenyl, and naphthyl groups)),

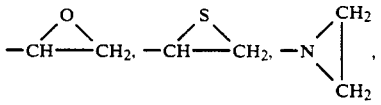

—$CONHCH_2OR_6$ (wherein $R_6$ represents a hydrogen atom or an alkyl group having from 1 to 8 carbon atoms (e.g., methyl, ethyl, propyl, butyl, hexyl, and octyl groups), —N=C=O, and a group containing polymerizable double bond

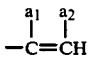

(wherein $a_1$ and $a_2$ each represents a hydrogen hydrogen atom, a halogen atom (e.g., chlorine and bromine atoms) or an alkyl group having from 1 to 4 carbon atoms (e.g., methyl and ethyl groups)). Also, specific examples of the above-described groups containing a polymerizable double bond include polymerizable groups having a lower polymerization reactivity than that of the monomer corresponding to the repeating unit of formula (I), for example,

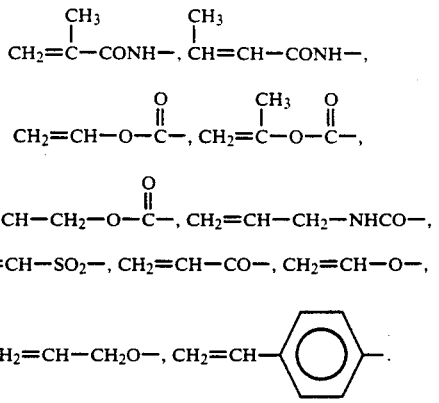

Examples of the repeating unit containing a heat- and/or photo-curable functional group are shown below. In the examples, $T_1$ and $T_2$ each represents —H or —$CH_3$, $R_{12}$ represents —CH=$CH_2$ or —$CH_2CH$=$CH_2$, $R_{13}$ represents

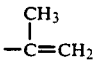

or —CH=$CHCH_3$, $R_{14}$ represents —$CH_2CH$=$CH_2$ or

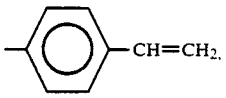

$R_{15}$ represents —CH=$CH_2$,

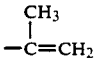

or —CH=$CHCH_3$, $R_{16}$ represents —CH=$CH_2$,

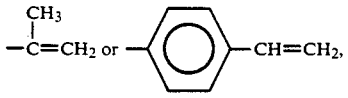

$R_{17}$ represents an alkyl group having 1 to 4 carbon atoms, e represents an integer of from 1 to 11, f represents an integer of from 1 to 10, g represents an integer of 1 to 4, h represents an integer of 2 to 11, $Z_1$ represents —S— or —O—, and $Z_2$ represents —OH or —$NH_2$.

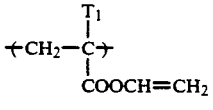

ii-1)

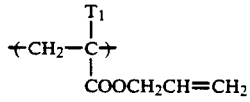

ii-2)

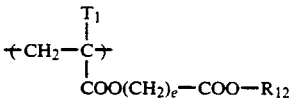

ii-3)

-continued ii-4)

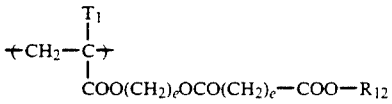

(e's may be the same or different)

ii-5)

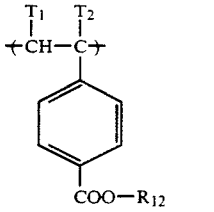

ii-6)

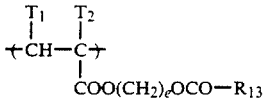

ii-7)

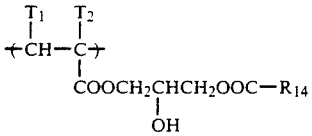

ii-8)

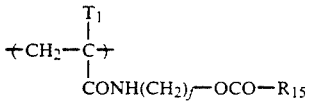

ii-9)

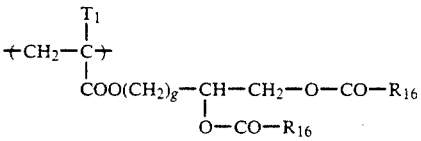

($R_{16}$'s may be the same or different)

ii-10)

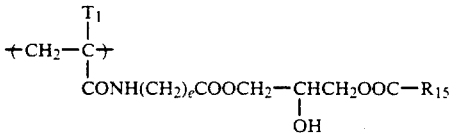

ii-11)

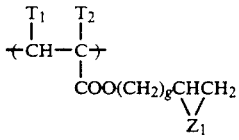

ii-12)

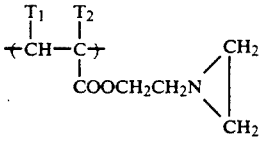

ii-13)

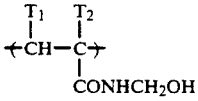

ii-14)

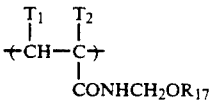

-continued ii-15)

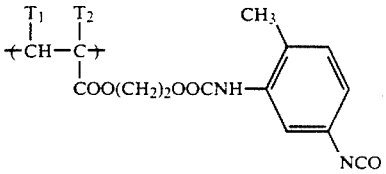

ii-16)

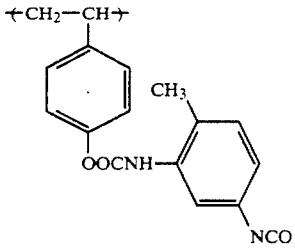

ii-17)

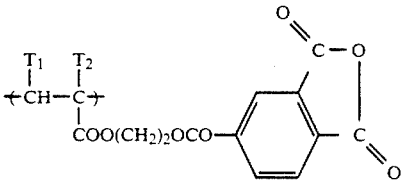

ii-18)

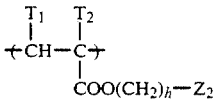

ii-19)

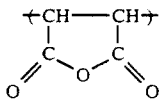

ii-20)

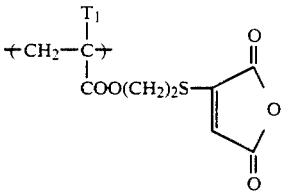

ii-21)

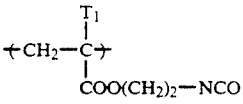

ii-22)

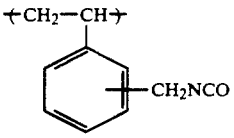

Further, the resin (A) of the present invention may contain other polymer components in combination with the above-described polymer components, i.e., the polymer component selected from the repeating unit represented by formula (I), (Ia) and/or (Ib), the polymer component for forming the crosslinked structure, and the optional polymer component containing a heat- and/or photo-curable functional group. The other polymer components may be any components as long as they are copolymerizable with the above polymer components, and examples of such other components include the repeating unit represented by formula (II):

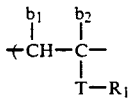

(II)

wherein T represents

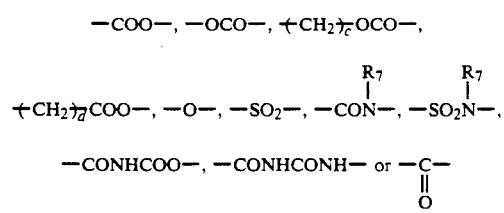

(wherein c and d each represents an integer of 1 or 2, $R_7$ represents the same group as $R_1$ in formula (I)); $R_1$ represents the same group as $R_1$ in formula (I); and $b_1$ and $b_2$, which may be the same or different, each represents a hydrogen atom, a halogen atom, a cyano group, a hydrocarbon group having from 1 to 8 carbon atoms, —COO—$R_8$ or —COO—$R_8$ bonded via a hydrocarbon group having from 1 to 8 carbon atoms wherein $R_8$ represents a hydrocarbon group having from 1 to 18 carbon atoms. More preferably, $b_1$ and $b_2$, which may be the same or different, each represents a hydrogen atom, an alkyl group having from 1 to 3 carbon atoms, e.g., methyl, ethyl, and propyl groups), —COO—$R_8$ or —$CH_2$COO—$R_8$ (wherein $R_8$ preferably represents an alkyl group having from 1 to 18 carbon atoms or an alkenyl group having from 3 to 18 carbon atoms, e.g., methyl, ethyl, propyl, butyl, hexyl, octyl, decyl, dodecyl, tridecyl, tetradecyl, hexadecyl, octadecyl, pentenyl, hexenyl, octenyl and decenyl groups, and these alkyl and alkenyl groups may have a substituent as described for the above $R_1$.

Further, other monomers which constitute repeating units other than the above repeating unit include, for example, styrenes (e.g., styrene, vinyltoluene, chlorostyrene, bromostyrene, dichlorostyrene, vinylphenol, methoxystyrene, chloromethylstyrene, methoxymethylstyrene, acetoxystyrene, methoxycarbonylstyrene, and methylcarbamoylstyrene), acrylonitrile, methacrylonitrile, acrolein, methacrolein, vinyl group-containing heterocyclic compounds (e.g., N-vinylpyrrolidone, vinylpyridine, vinylimidazole, and vinylthiophene), acrylamide, and methacrylamide, but the other copolymer components used in the present invention are not limited to these monomers.

Furthermore, the resin (A) used in the binder resin of the present invention is characterized by containing an acidic group selected from the group consisting of a —$PO_3H_2$ group, a —$SO_3H$ group, a —COOH group,

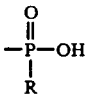

group (wherein R represents a hydrocarbon group or a —OR′ group (wherein R′ represents a hydrocarbon group) and a cyclic acid anhydride-containing group, bonded to only one terminal of the polymer main chain of at least one polymer having the above-described crosslinked structure.

The content of the acidic group bonded to the terminal of the polymer main chain is preferably from 0.5 to 15% by weight, and more preferably from 2 to 10% by weight, based on the weight of the resin (A).

When the content of the acidic group in the resin (A) is lower than 0.5% by weight, the initial potential is low and a sufficient image density cannot be obtained. On the other hand, when the content of the acidic group is higher than 15% by weight, the dispersibility is decreased, and the smoothness of the film and the electrophotographic properties at higher humidity decrease, and, further, the background stains are increased when the electrophotographic light-sensitive material is used as an offset master.

In the

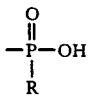

group contained in the resin (A) as an acidic group bonded to only one terminal of the polymer main chain, R represents a hydrocarbon group or a —OR′ group (wherein R′ represents a hydrocarbon group), and, preferably, R and R′ each represents an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl groups) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl groups).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine atoms) and an alkyl group (e.g., methyl, ethyl, butyl, and hexyl groups).

Specific examples of the aromatic dicarboxylic acid anhydrides include phthalic anhydride ring, naphtnalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine atoms), an alkyl group (e.g., methyl, ethyl, propyl, and butyl groups), a hydroxyl group, a cyano group, a nitro group, and an alkoxycarbonyl group (e.g., methoxycarbonyl and ethoxycarbonyl groups).

The above described specific acidic group bonded to only one terminal of the polymer chain has either a chemical structure where the acidic group in directly bonded or bonded via a linkage group to one terminal of the polymer main chain.

The linkage group bonding the acidic group-containing component includes a carbon-carbon bond (single bond or double bond), carbon-hetero atom bond (examples of the hetero atom are oxygen, sulfur, nitrogen, and silicon), and a hetero atom-hetero atom bond, or an optional combination of these atomic groups.

Specific examples of the linkage group include a single linkage group selected from

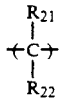

(wherein $R_{21}$ and $R_{22}$ each represents a hydrogen atom, a halogen atom (e.g., fluorine, chlorine, and bromine atoms), a cyano group, a hydroxy group, or an alkyl group (e.g., methyl, ethyl and propyl groups),

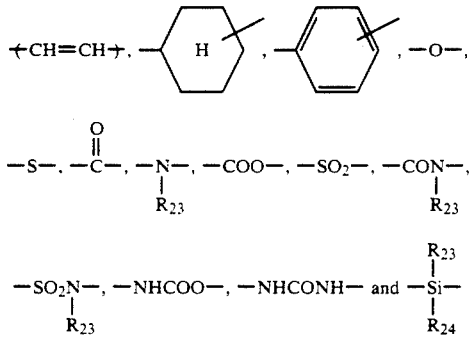

(wherein $R_{23}$ and $R_{24}$ each represents a hydrogen atom, a hydrocarbon group having from 1 to 8 carbon atoms (e.g., methyl, ethyl, propyl, butyl, pentyl, hexyl, benzyl, phenethyl, phenyl and tolyl groups) or —$OR_{25}$ wherein $R_{25}$ represents the same hydrocarbon group as described for $R_{23}$.

The resin (A) according to the present invention, in which the specific acidic group is bonded to only one terminal of the polymer main chain, can easily be prepared by an ion polymerization process, in which a reagent of various kinds is reacted at the terminal of a living polymer obtained by conventionally known anion polymerization or cation polymerization; a radical polymerization process, in which radical polymerization is performed in the presence of a polymerization initiator and/or a chain transfer agent which contains the specific acidic group in the molecule thereof; or a process in which a polymer having a reactive group at the terminal obtained by the above-described ion polymerization or radical polymerization is subjected to a high molecular reaction to convert the terminal to the specific acidic group.

For the details, reference can be made to P. Dreyfuss and R. P. Quirk, *Encycl. Polym. Sci. Eng.*, Vol. 7, p. 551 (1987), Yoshiki Nakajo and Yuya Yamashita, *Senryo to Yakuhin*, Vol. 30, p. 232 (1985), Akira Ueda and Susumu Nagai, *Kagaku to Kogyo*, Vol. 60, p. 57 (1986) and literature references cited therein.

The polymer of the resin (A) used in the present invention can be prepared by a method of polymerizing a mixture of a monomer corresponding to the repeating unit represented by formula (I), a polyfunctional monomer for forming the above-described crosslinked structure, other optional monomers, and a chain transfer agent containing an acidic group to be bonded to one terminal, in the presence of a polymerization initiator (e.g., azobis type compounds, peroxides, etc.), a method of polymerizing the above mixture but using a polymerization initiator instead of the chain transfer agent, a method of polymerizing the above mixture except for using a chain transfer agent and a polymerization initiator both containing an acidic group, or any of the above three types of method wherein the polymerization is conducted using a chain transfer agent and/or a polymerization initiator containing an amino group, a halogen atom, an epoxy group, an acid halide group, etc. as a substituent, and then the substituent in the resulting polymer is converted into an acidic group through a polymer reaction.

Specific examples of the chain transfer agent to be used include mercapto compounds containing the acidic group or the reactive group capable of being converted to the acidic group (e.g., thioglycolic acid, thiomalic acid, thiosalicyclic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mecaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, 2-mercapto-3-pyridinol), and alkyl iodide compounds containing the acidic group or the acidic-group forming reactive group (e.g., iodoacetic acid, iodopropionic acid, 2-iodoethanol, 2-iodoethanesulfonic acid, and 3-iodopropanesulfonic acid). Of these compounds, mercapto compounds are preferred.

The chain transfer agent or the polymerization initiator is usually used in an amount of from about 0.5 to about 15 parts by weight, preferably from 1 to 10 parts by weight, per 100 parts by weight of the total monomers.

In the present invention, at least one heat- and/or photo-curable resin (B) can be used together with the resin (A) according to the present invention, whereby the film strength of the electrophotographic light-sensitive material can be improved without adversely affecting the properties of the resin (A).

The resin (B) which can be incorporated into the binder resin in the present invention is a heat- and/or photo-curable resin having a crosslinkable functional group, i.e., a functional group of forming a cross-linkage between polymers by causing a crosslinking reaction by the action of at least one of heat and light, and, preferably a resin which is capable of forming a crosslinked structure by reacting with the above-described functional group which can be contained in the resin (A).

That is, a reaction which causes bonding of molecules by a condensation reaction, an addition reaction, etc., or crosslinking by a polymerization reaction by the action of heat and/or light is utilized.

The heat-curable functional group include, practically, a group composed of at least one combination of a functional group having a dissociating hydrogen atom (e.g., —OH, —SH, and —$NHR_{31}$ (wherein $R_{31}$ represents a hydrogen atom, an aliphatic group having from 1 to 12 carbon atoms which may be substituted, and an aryl group which may be substituted) and a functional group selected from

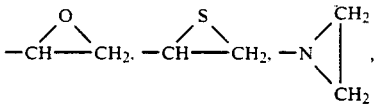

—NCO, —NCS, and a cyclic dicarboxylic acid anhydride; —$CONHCH_2OR_{32}$ ($R_{32}$ represents a hydrogen atom or an alkyl group having from 1 to 6 carbon atoms such as methyl, ethyl, propyl, butyl, and hexyl groups); and a polymerizable double bond group.

The functional group having a dissociating hydrogen atom include, preferably, —OH, —SH, and $NHR_{31}$.

Examples of the above polymerizable double bond group and the photo-curable functional group are those described above for the heat- and/or photo-curable functional groups contained in the resin (A).

Polymers or copolymers containing such functional groups are illustrated as examples of the resin (B) of the present invention.

Practical examples of these polymers or copolymers are described in Tsuyoshi Endo, *Netsukokasei Kobunshi no Seimitsuka (making Thermo-setting Macromolecule Precise*, published by C.M.C., 1986, Yuji Harasaki, Newest Binder Technology Handbook, Chapter II-1, published by Sogo Gijutsu Center, 1985, Takayuki Ootsu, *Synthesis, Planning, and New Use Development of Acryl Resins*, published by Chubu Keiei Kaihatsu Center Suppan Bu, 1985, and Eizo Ohmori, *Functional Acrylic Resins*, published by Techno System (1985).

Specific examples of such polymers or copolymers are polyester resins, unmodified epoxy resins, polycarbonate resins, vinyl alkanoate resins, modified polyamide resins, phenol resins, modified alkyd resins, melamine resins, acryl resins, and styrene resins and these resins may have the above-described functional group capable of causing a crosslinking reaction in the molecule. It is preferred that these resins do not have the acidic group contained in the resin (A) or have not been modified.

Practical examples of the monomer corresponding to the copolymer component having the functional group are vinylic compounds having the functional group.

Examples thereof are described in *Macromolecular Data Handbook (foundation)*, edited by Kobunshi Gakkai, published by Baifunkan, 1986. Specific examples thereof are acrylic acid, α- and/or β-substituted acrylic acids (e.g., α-acetoxy compound, α-acetoxymethyl compound, α-(2-aminomethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and vinyl compounds having the above-described functional group in the substituent of the ester derivatives or amide derivatives of these carboxylic acids or sulfonic acids, or in the substituent of styrene derivatives.

More practically, a specific example of the resin (B) is a (meth)acrylic copolymer containing a monomer represented by following formula (I) as a copolymer component in an amount of at least 30% by weight.

The content of the copolymer component having the crosslinkable (crosslinking) functional group in the resin (B) is preferably from 0.5 to 40 mole%.

The weight average molecular weight of the resin (B) is preferably from about $1\times10^3$ to about $1\times10^5$, and preferably from $5\times10^3$ to $5\times10^4$.

The compounding ratio of the resin (A) and the resin (B) depends upon the kind and particle sizes of the inorganic photoconductive substance used and the surface state of the desired photoconductive layer, but the ratio of (A):(B) is from 5 to 80:95 to 20 by weight ratio, and preferably from 10 to 50:90 to 50 by weight.

On the other hand, when the resin (A) and/or resin (B) used in the present invention contains a heat- and/or photo-curable functional group, a crosslinking agent can be used together in order to accelerate the crosslinking in the film.

The crosslinking agents which can be used in the present invention include the compounds which are usually used as crosslinking agents. Practical compounds are described in Shinzo Yamashita & Tosuke Kaneko, *Crosslinking Agent Handbook*, published by Taisei Sha, 1981, and *Macromolecular Data Handbook (Foundation)*, edited by Kobunshi Gakkai, published by Baifuukan, 1986.

Specific examples thereof are organic silane series compounds (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, cyanate, o-toluylene diisocyanate, diphenylmethane diisocyanate, triphenylmethane triisocyanate, polyethylenepolyphenyl isocyanate, hexamethylene diisocyanate, isohorone diisocyanate, and macromolecular polyisocyanate), polyol series compounds (e.g., 1,4-butanediol, polyoxypropylene glycol, polyoxyalkylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described in Hiroshi Kakiuchi, *New Epoxy Resin* published by Shokodo, 1985 and Kuniyuki Hashimoto, *Epoxy Resins*, published by Nikkan Kogyo Shinbun Sha, 1969), melamine resins (e.g., the compounds described in Ichiro Miwa and Hideo Matsunaga, *Urea·melamine Resins*, published by Nikkan Kogyo Shinbun Sha, 1969), and poly(meth)acrylate series compounds (e.g., the compounds described in Shin Ogawara, Takeo Saegusa, and Toshinobu Higashimura, *Oligomer*, published by Kodansha, 1976, and Eizo Ohmori, *Functional Acrylic Resins*, published by Techno System, 1985, such as, practically, polyethylene glycol diacrylate, neopentyl glycol diacrylate, 1,6-hexanediol acrylate, trimethylolpropane triacrylate, pentaerythritol polyacrylate, bisphenol A-diglycidyl ether diacrylate, oligoester acrylate, and corresponding methacrylates).

The amount of the crosslinking agent used in the present invention is from about 0.5 to about 30% by weight, and preferably from 1 to 10% by weight, based on the amount of the resin binder.

In the present invention, the binder resin may, if necessary, contain a reaction accelerator for accelerating the crosslinking reaction of the photoconductive layer.

When the crosslinking reaction is of a reaction type for forming a chemical bond between the functional groups, organic acids (e.g., acetic acid, propionic acid, butyric acid, benzenesulfonic acid, and p-toluenesulfonic acid) can be used as the crosslinking agent.

When the crosslinking reaction is of a polymerization reaction type, polymerization initiators (e.g., peroxides and azobis series compounds, preferably azobis series polymerization initiators) or monomers having a polyfunctional polymerizable group (e.g., vinyl methacrylate, allyl methacrylate, ethylene glycol diacrylate, divinylsuccinic acid esters, divinyladipic acid esters, diallylsuccinic acid esters, 2-methylvinyl methacrylate, and divinylbenzene) can be used.

When the resin (A) and/or the resin (B) contains a heat- and/or photo-curable functional group, the coating composition containing the binder resin of the present invention for forming a photoconductive layer is coated on a support and is crosslinked or subjected to thermosetting. For performing crosslinking or thermosetting, a severer drying condition than that used for producing conventional electrophotographic light-sensitive materials can be employed. For example, the drying step is carried out at a higher temperature and/or for a longer time. Also, after evaporating off the solvent in the coating composition by drying, the photoconductive layer may be further subjected to a heat treatment, for example, at from 60° to 120° C. for from 5 to 120 minutes. In the case of using the above-described reaction accelerator, a milder drying condition can be employed.

In the present invention using the resin having a crosslinked structure and the curable resin, it is considered that these resins form an interpenetrating polymer network structure in the photoconductive layer by crosslinking. Such a network structure results in a remarkable improvement in the chemical bond density between the resins by the three-dimensional crosslinked structure as compared with the photoconductive layer having a planner crosslinked network structure. Thus, the film strength is markedly improved, and, when the light-sensitive material is used as a printing plate, the water retention property of the photoconductive layer corresponding to the non-image area is also markedly improved after an oil-desensitization treatment due to the increase in the water-absorption ability by the three-dimensional network structure. As a result, prints having clear images without background stains can be obtained.

In the present invention, the binder resin may contain the resin (A) having a weight average molecular weight of from $1\times10^3$ to $1\times10^4$ in combination with one of the following resins (C), (D) and (E) each having a high molecular weight (a weight average molecular weight in the range of from $5\times10^4$ to $5\times10^5$).

The resin (C) which can be used in the present invention is the resin having a weight average molecular weight of from $5\times10^4$ to $5\times10^5$ and containing neither $-PO_3H_2$, $-SO_3H$, $-COOH$ and

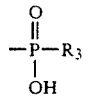

groups (wherein $R_3$ represents a hydrocarbon group or a $-OR_4$ group wherein $R_4$ represents a hydrocarbon group) nor a basic group.

The resin (D) which can be used in the present invention is the resin having a weight average molecular weight of from $5\times10^4$ to $5\times10^5$ and containing from 0.1 to 15% by weight of a copolymer component having at least one functional group selected from a —OH group and a basic group.

The resin (E) which can be used in the present invention is the resin having a weight average molecular weight of from $5\times10^4$ to $5\times10^5$, and containing either a copolymer component having an acidic group in a content of less than 50% of the content of the acidic group contained in the resin (A) or a copolymer component having at least one acidic group selected from $-PO_3H_2$, $-SO_3H$, —COOH and

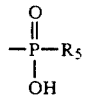

(wherein $R_5$ represents a hydrocarbon group or a $-OR_6$ group wherein $R_6$ represents a hydrocarbon group) having a pKa value larger than that of the acidic group contained in the resin (A).

By using the resin (C), (D) or (E), the mechanical strength of the photoconductive layer can be improved. That is, the resin (C), (D) and (E) improve the mechanical strength of the photoconductive layer without adversely affecting the high performance in the electrophotographic properties obtained by the resin (A) and also provide a sufficient image forming performance even when the environmental conditions are changed as described above or a laser beam of low output is used.

The above improvements are considered to be achieved due to that the strength of the interaction between the inorganic photoconductive substance and the binder resins can be suitably changed by using the resin (A) and the resin (C), (D) or (E) having a specific weight average molecular weight, a specific content of the acidic or functional group and a specific position at which the acidic or functional group is bonded. More specifically, it is considered that the electrophotographic properties and the mechanical strength of the film can be improved markedly due to that the resin (A) having a stronger interaction is selectively and suitably adsorbed on the inorganic photoconductive substance and the resin (C), (D) or (E) having a relatively lower interaction mildly acts on the inorganic photoconductive substance to a degree that the electrophotographic properties are not adversely affected.

Also, in the electrophotographic light-sensitive material of the present invention using the low molecular resin (A) and one of the high molecular resins (C), (D) and (E) together, the surface of the photoconductive layer has good smoothness in the case of using as an electrophotographic lithographic printing master plate. Also, since photoconductive particles such as zinc oxide particles are sufficiently dispersed in the binder resin, when the photoconductive layer is subjected to an oil-desensitizing treatment with an oil-desensitizing solution after imagewise exposure and processing, the non-image portions are sufficiently and uniformly rendered hydrophilic and sticking of a printing ink to the non-image portions at printing is inhibited, whereby no background staining occurs even by printing 10,000 prints.

That is, in the present invention, when the resin (A) and one of the resins (C) to (E) are used together, the binder resin is suitably adsorbed onto inorganic photoconductive particles and suitably coats the particles, whereby the film strength of the photoconductive layer is sufficiently maintained.

Then, the use of a combination of the low molecular weight resin (A) and the high molecular weight resin (C) having neither acidic group nor basic group in the binder resin (A) of the present invention is explained in detail.

The resin (C) which can be used in the present invention is the resin having a weight average molecular weight of from $5\times10^4$ to $5\times10^5$ and having neither the above-described acidic group (i.e., the acidic group at the terminal of the main chain in the resin (A)) nor a basic group at the terminal of the grafted portion and the terminal of the main chain of the copolymer. The weight average molecular weight of the resin (C) is preferably from $8\times10^4$ to $3\times10^5$.

The glass transition point of the resin (C) is in the range of preferably from 0° C. to 120° C., and more preferably from 10° C. to 80° C.

Any resins (C) which are conventionally used as a binder resin for electrophotographic light-sensitive materials can be used in the present invention alone or as a combination thereof. Examples of these resins are described in Harumi Miyahara and Hidehiko Takei, *Imaging*, Nos. 8 and 9 to 12, 1978 and Ryuji Kurita and Jiro Ishiwata, *Kobunshi* (*Macromolecule*), 17, 278–284 (1968).

Specific examples of the resin (C) are an olefin polymer, an olefin copolymer, a vinyl chloride copolymer, a vinylidene chloride copolymer, a vinyl alkanoate polymer, a vinyl alkanoate copolymer, an allyl alkanoate polymer, an allyl alkanoate copolymer, styrene, a styrene derivative, a styrene polymer, a styrene copolymer, a butadiene-styrene copolymer, an isoprene-styrene copolymer, a butadiene-unsaturated carboxylic acid ester copolymer an acrylonitrile copolymer, a methacrylonitrile copolymer, an alkyl vinyl ether copolymer, an acrylic acid ester polymer, an acrylic acid ester copolymer, a methacrylic acid ester polymer, a methacrylic acid copolymer, a styrene-acrylic acid ester copolymer, a styrene-methacrylic acid ester copolymer, an itaconic acid diester polymer, an itaconic acid diester copolymer, a maleic anhydride copolymer, an acrylamide copolymer, a methacrylamide copolymer, a hydroxy group-modified silicone resin, a polycarbonate resin, a ketone resin, an amide resin, a hydroxy group- or carboxy group-modified polyester resin, a butyral resin, a polyvinyl acetal resin, a cyclized rubber-methacrylic acid ester copolymer, a cyclized rubber-acrylic acid ester copolymer, a copolymer having a heterocyclic group containing no nitrogen atom (examples of the heterocyclic ring are furan, tetrahydrofuran, thiophene, dioxane, dioxolan, lactone, benzofuran, benzothiophene, and 1,3-dioxetane rings), and an epoxy resin.

More practically, examples of the resin (C) include (meth)acrylic copolymers or polymers each containing at least one monomer shown by the following formula (III) as a (co)polymer component in a total amount of at least 30% by weight;

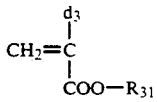

(III)

wherein $d_3$ represents a hydrogen atom, a halogen atom (e.g., chlorine and bromine atoms), a cyano group, or an alkyl group having from 1 to 4 carbon atoms, and is preferably an alkyl group having from 1 to 4 carbon atoms, and $R_{31}$ represents an alkyl group having from 1 to 18 carbon atoms, which may be substituted (e.g., methyl, ethyl, propyl, butyl, pentyl, hexyl, octyl, decyl, dodecyl, tridecyl, tetradecyl, 2-methoxyethyl, and 2-ethoxyethyl groups), an alkenyl group having from 2 to 18 carbon atoms, which may be substituted (e.g., vinyl, allyl, isopropenyl, butenyl, hexenyl, heptenyl, and octenyl groups), an aralkyl group having from 7 to 14 carbon atoms, which may be substituted (e.g., benzyl, phenethyl, methoxybenzyl, ethoxybenzyl, and methylbenzyl groups), a cycloalkyl group having from 5 to 8 carbon atoms, which may be substituted (e.g., cyclopentyl, cyclohexyl, and cycloheptyl groups), or an aryl group (e.g., phenyl, tolyl, xylyl, mesityl, naphthyl, methoxyphenyl, ethoxyphenyl, chlorophenyl, and dichlorophenyl groups).

In formula (III), $R_{31}$ represents preferably an alkyl group having from 1 to 4 carbon atoms, an aralkyl group having from 7 to 14 carbon atoms which may be substituted (particularly, the aralkyl group preferably includes benzyl, phenethyl, naphthylmethyl, and 2-naphthylethyl groups, each of which may be substituted), or a phenethyl group or a naphthyl group which may be substituted (examples of the substituent are chlorine and bromine atoms, methyl, ethyl, propyl, acetyl, methoxycarbonyl, and ethoxycarbonyl groups, and the phenethyl group or naphthyl group may have 2 or 3 substituents).

Furthermore, in the resin (C), a component which is copolymerized with the above-described (meth)acrylic acid ester may be any monomer other than the monomer shown by formula (III), and examples of the monomer are α-olefins, alkanoic acid vinyl esters, alkanoic acid allyl esters, acrylonitrile, methacrylonitrile, vinyl ethers, acrylamides, methacrylamides, styrenes, and heterocyclic vinyls (e.g., 5- to 7-membered heterocyclic rings having from 1 to 3 non-metallicaatoms other than nitrogen atom (e.g., oxygen and sulfur atoms), and practical examples are vinylthiophene, vinyldioxane, and vinylfuran).

Preferred examples of the monomer are alkanoic acid vinyl esters or alkanoic acid allyl esters each having from 1 to 3 carbon atoms, acrylonitile, methacrylonitrile and styrene derivatives (e.g., vinyltoluene, butylstyrene, methoxystyrene, chlorostyrene, dichlorostyrene, bromostyrene, and ethoxystyrene).

On the other hand, the resin (C) used in the present invention does not contain a basic group and examples of such basic groups include an amino group and a nitrogen atom-containing heterocyclic group, which may have a substituent.

In the acidic group

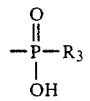

which is not contained in the resin (C), $R_3$ represents the same group as $R_0$.

Then, the use of a combination of the above-described low molecular weight resin (A) and the high molecular weight resin (D) having at least one of —OH and a basic group in the binder resin of the present invention is described hereinafter in detail.

In the resin (D), the content of the copolymer component containing —OH and/or a basic group is from 0.05 to 15% by weight, and preferably from 0.5 to 10% by weight of the resin (D). The weight average molecular weight of the resin (D) is from $5\times10^4$ to $5\times10^5$, and preferably from $8\times10^4$ to $1\times10^5$. The glass transition point of the resin (D) is in the range of preferably from 0° C. to 120° C., and preferably from 10° C. to 80° C.

In the present invention, it is considered that the OH component or the basic group component in the resin (D) has a weak interaction with the interface with the photoconductive particles and the resin (A) to stabilize the dispersion of the photoconductive particles and improve the film strength of the photoconductive layer after being formed. However, if the content of the OH or basic group component in the resin (D) exceeds 15% by weight, the photoconductive layer formed tends to be influenced by moisture, and thus the moisture resistance of the photoconductive layer tend to decrease. However, any conventionally known resins having such properties can be used as the resin (D) in the present invention as long as they have the above-described properties, as described for the resin (C).

Practically, the above-described (meth)acrylic copolymers each containing the monomer shown by formula (III) describe above in a proportion of at least 30% by weight as the copolymer component can be used as the resin (D).

As "the copolymer component containing —OH and/or a basic group" contained in the resin (D), any vinylic compounds each having the substituent (i.e., —OH and/or the basic group) copolymerizable with the monomer shown by aforesaid formula (III) can be used.

The aforesaid basic group in the resin (D) include, for example, an amino group represented by the following formula (IV) and a nitrogen-containing heterocyclic group:

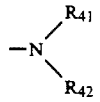

(IV)

wherein $R_{41}$ and $R_{42}$, which may be the same or different, each represents a hydrogen atom, an alkyl group which may be substituted (e.g., methyl, ethyl, propyl, butyl, hexyl, octyl, decyl, dodecyl, tetradecyl, octadecyl, 2-bromoethyl, 2-chloroethyl, 2-hydroxyethyl, and 3-ethoxypropyl groups), an alkenyl group which may be substituted (e.g., allyl, isopropenyl and 4-butynyl groups), an aralkyl group which may be substituted (e.g., benzyl, phenethyl, chlorobenzyl, methylbenzyl, methoxybenzyl, and hydroxybenzyl groups), an alicyclic group (e.g., cyclopentyl and cyclohexyl groups), or an aryl group (e.g., phenyl, tolyl, xylyl, mesityl, butylphenyl, methoxyphenyl, and chlorophenyl groups). Furthermore, $R_{41}$ and $R_{42}$ each may be bonded by a hydrocarbon group through, if desired, a hetero atom.

The nitrogen-containing heterocyclic ring as the basic group in the resin (D) include, for example, 5- to 7-membered heterocyclic rings each containing from 1 to 3 nitrogen atoms, and the heterocyclic ring may further contain a condensed ring with a benzene ring, a naphthalene ring, etc. These heterocyclic rings may have a substituent.

Specific examples of the heterocyclic ring are pyrrole, imidazole, pyrazole, pyridine, piperazine, pyrimidine, pyridazine, indolizine, indole, 2H-pyrrole, 3H-indole, indazole, purine, morpholine, isoquinoline, phthalazine, naphthyridine, quinoxaline, acridine, phenanthridine, phenazine, pyrrolidine, pyrroline, imidazolidine, imidazoline, pyrazoline, piperidine, piperazine, quinacridine, indoline, 3,3-dimethylindolenine, 3,3-dimethylnaphthindolenine, thiazole, benzothiazole, naphthothiazole, oxazole, benzoxazole, naphthoxazole, selenazole, benzoselenazole, naphthoselenazole, oxazoline, isooxazoline, benzoxazole, morpholine, pyrrolidone, triazole, benzotriazole, and triazine rings.

The above-described copolymer component or monomer having —OH and/or the basic group is obtained by incorporating —OH and/or the basic group into the substituent of an ester derivative or amide derivative derived from a carboxylic acid or sulfonic acid having a vinyl group as described in *Kobunshi* (*Macromolecular*) *Data Handbook* (*Foundation*), edited by Kobunshi Gakkai, published by Baifukan, 1986.

Specific examples of such a monomer (copolymer component) are 2-hydroxyethyl methacrylate, 3-hydroxypropyl methacrylate, 3-hydroxy 2-chloromethacrylate, 4-hydroxybutyl methacrylate, 6-hydroxyhexyl methacrylate, 10-hydroxydecyl methacrylate, N-(2-hydroxyethyl)acrylamide, N-(3-hydroxypropyl)-methacrylamide, N-(α,α-dihydroxymethyl)ethylmethacrylamide, N-(4-hydroxybutyl) methacrylamide, N,N-dimethylaminoethyl methacrylate, 2-(N,N-diethylaminoethyl) methacrylate, 3-(N,N-dimethylpropyl) methacrylate, 2-(N,N-dimethylethyl)methacrylamide, hydroxystyrene, hydroxymethylstyrene, N,N-dimethylaminomethylstyrene, N,N-diethylaminomethylstyrene, N-butyl-N-methylaminomethylstyrene, and N-(hydroxyphenyl)methacrylamide.

Examples of the vinyl compound having a nitrogen-containing heterocyclic ring are described in the above-described *Macromolecular Data Handbook* (*Foundation*), pages 175 to 181, D.A. Tomalia, *Reactive Heterocyclic Monomers*, Chapter 1 of Functional Monomers, Vol. 2, Marcel DeRRer Inc., N.Y., 1974, and L.S. Lusrin, *Basic Monomers*, Chapter 3 of *Functional Monomers*, Vol. 2, Marcel DeRRer Inc., N.Y., 1974.

Furthermore, the resin (D) may contain monomers other than the above-described monomer having —OH and/or the basic group in addition to the latter monomer as a copolymer component. Examples of such monomers are those described above for the monomers which can be used as other copolymer components for the resin (C).

Then, the use of a combination of the above-described low molecular weight resin (A) and the high molecular weight resin (E) having an acidic group as the side chain of the copolymer component at a content of less than 50%, and preferably less than 30% of the content of the acidic group contained in the resin (A) or an acidic group having a pKa value larger than that of the acidic group contained in the resin (A) as the side chain of the copolymer component is described in detail.

The weight average molecular weight of the resin (E) is from $5\times10^4$ to $5\times10^5$, and preferably from $7\times10^4$ to $4\times10^5$.

The acidic group contained in the side chain of the copolymer in the resin (E) is preferably contained in the resin (E) at a proportion of from 0.05 to 3% by weight and more preferably from 0.1 to 1.5% by weight. Also, it is preferred that the acidic group is incorporated in the resin (E) in a combination of the acidic group in the resin (A) shown in Table A below.

TABLE A

| Acidic Group in Resin (A) | Acidic Group in Resin (E) |
|---|---|
| $-SO_3H$ and/or $-PO_3H_2$ | $-COOH$ |
| $-SO_3H$, $-PO_3H_2$ and/or $-COOH$ | $-\overset{\overset{\displaystyle O}{\|}}{\underset{\underset{\displaystyle OH}{\|}}{P}}-OR_5$ |

The glass transition point of the resin (E) is preferably in the range of from 0° C. to 120° C., more preferably from 0° C. to 100° C., and most preferably from 10° C. to 80° C.

The resin (E) shows a very weak interaction on photoconductive particles as compared to the resin (A), has a function of mildly coating the particles, and sufficiently increases the mechanical strength of the photoconductive layer, without adversely affecting the function of the resin (A), when the strength thereof is insufficient by the resin (A) alone.

If the content of the acidic group in the side chain of the resin (E) exceeds 3% by weight, the adsorption of the resin (E) onto photoconductive particles occurs whereby the dispersion of the photoconductive particles is destroyed and aggregates or precipitates are formed, which result in causing a state of not forming coated layer or greatly reducing the electrostatic characteristics of the photoconductive particles even if the coated layer is formed. Also, in such a case, the surface property of the photoconductive layer is roughened thereby reducing the strength to mechanical friction.

Specific examples of $R_5$ in $$-\overset{\overset{\displaystyle O}{\|}}{\underset{\underset{\displaystyle OH}{\|}}{P}}-OR_5$$

$$-\overset{\overset{\displaystyle O}{\|}}{\underset{\underset{\displaystyle OH}{\|}}{P}}-R_5$$

of the resin (E) include an alkyl group having from 1 to 12 carbon atoms which may be substituted (e.g., methyl, ethyl, propyl, butyl, hexyl, octyl, decyl, dodecyl, 2-chloroethyl, 2-methoxyethyl, 2-ethoxyethyl, and 3-methoxypropyl groups), an aralkyl group having from 7 to 12 carbon atoms, which may be substituted (e.g., benzyl, phenethyl, chlorobenzyl, methoxybenzyl, and methylbenzyl groups), an alicyclic group having from 5 to 8 carbon atoms, which may be substituted (e.g., cyclopentyl and cyclohexyl groups), and an aryl group which may be substituted (e.g., phenyl, tolyl, xylyl, mesityl, naphthyl, chlorophenyl, and methoxyphenyl groups).

Any conventional known resins can be used in the present invention as the resin (E) as long as they have the above-described properties and, for example, the conventionally known resins described above for the resin (C) can be used.

More practically, examples of the resin (E) include a (meth)acrylic copolymer containing the monomer shown by formula (III) described above as the copolymer component in a proportion of at least 30% by weight of the copolymer.

Also, as the copolymer component having an acidic group in the resin (E) used in the present invention, any acidic group-containing vinyl compounds copolymerizable with the monomer shown by the above formula (III) can be used. For example, such vinyl compounds are described in *Macromolecular Data Handbook* (*Foundation*), edited by Kobunshi Gakkai, Baifukan, 1986. Specific examples of the vinyl compounds are acrylic acid, α- and/or β-substituted acrylic acid (e.g., α-acetoxy compound, α-acetoxymethyl compound, α-(2-amino)methyl compound, α-chloro compound, α-bromo compound, α-fluoro compound, α-tributylsilyl compound, α-cyano compound, β-chloro compound, β-bromo compound, α-chloro-β-methoxy compound, α,β-dichloro compound), methacyylic acid, itaconic acid, itaconic acid half esters, itaconic acid half amides, crotonic acid, 2-alkenylcarboxylic acids (e.g., 2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids containing the acidic group in the substituent thereof.

Specific examples of these compounds are shown below, wherein e represents —H, $-CH_3$, —Cl, —Br, —CN, $-CH_2COOCH_3$ or $-CH_2COOH$, f represents —H or $-CH_3$, $n_1$ represents an integer of 2 to 18, $m_1$ represents an integer of from 1 to 12, and $l_1$ represents an integer of 1 to 4.

$$CH_2=\overset{\overset{\displaystyle e}{|}}{\underset{\underset{\displaystyle COOH}{|}}{C}} \quad (1)$$

$$\overset{\overset{\displaystyle CH_3}{|}}{CH}=\underset{\underset{\displaystyle COOH}{|}}{CH} \quad (2)$$

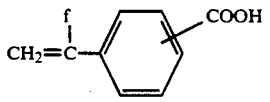

(3)

$$CH_2=\overset{\overset{\displaystyle f}{|}}{\underset{\underset{\displaystyle COO(CH_2)_{n_1}COOH}{|}}{C}} \quad (4)$$

-continued
(5)
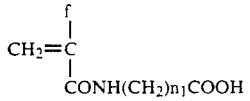
(6)
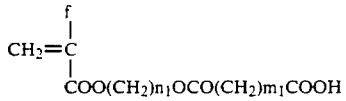
(7)
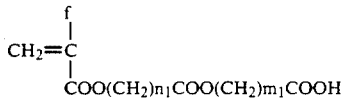
(8)
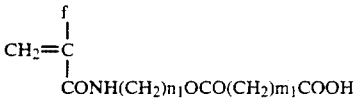
(9)
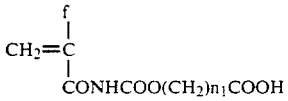
(10)
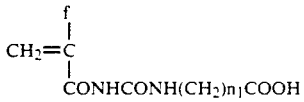
(11)
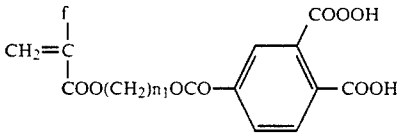
(12)
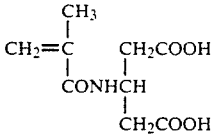
(13)
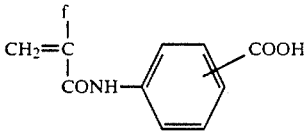
(14)
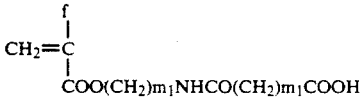
(wherein $m_1$'s may be the same or different)
(15) $CH_2=CH-CH_2OCO(CH_2)_{m_1}COOH$
(16) $CH_2=CH(CH_2)_{n_1}COOH$
(17)
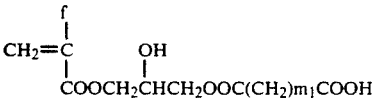
(18)
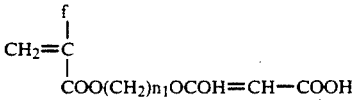
-continued
(19)
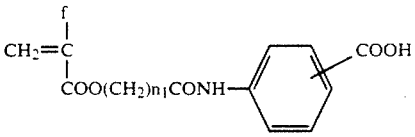
(20)
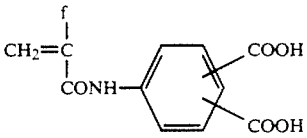
(21)
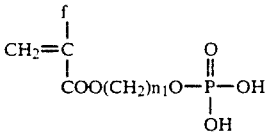
(22)
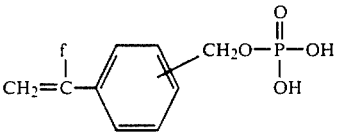
(23)
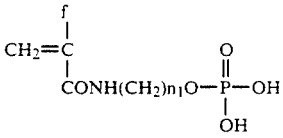
(24)
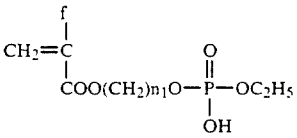
(25)
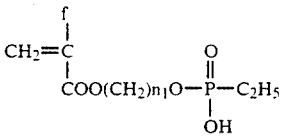
(26)
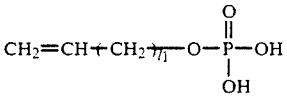
(27)
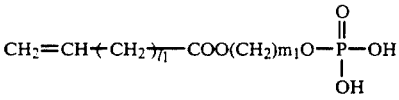
(28)
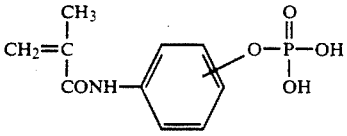
(29)
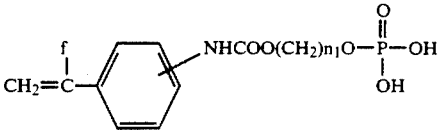
(30)
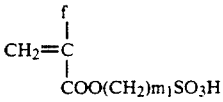

-continued

(31) 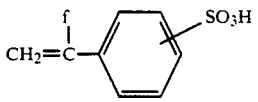

(32) 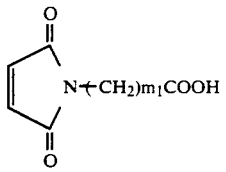

(33) 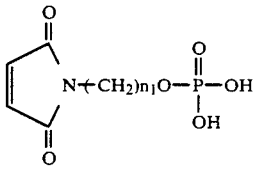

(34) 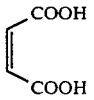

(35) 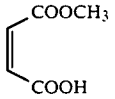

(36) 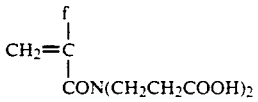

(37) 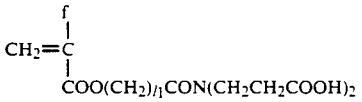

(38) 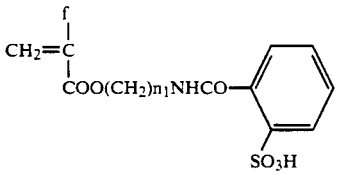

(39) 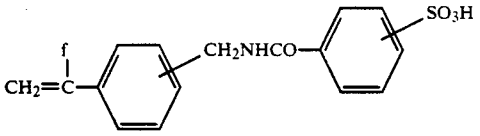

(40) 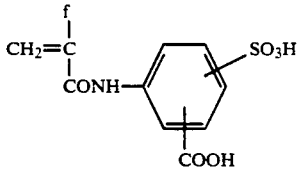

(41) 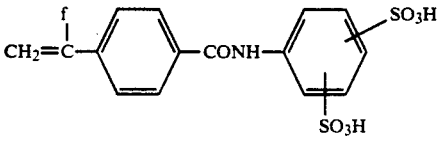

Further, the resin (E) of the present invention may contain, as a copolymer component, monomers other than the monomer of the formula (III) and the monomer containing the acidic group. Examples such monomers are those described for the resin (C) as other copolymer components which can be contained in the resin (C).

Furthermore, the binder resin of the present invention may further contain other resins in addition to the above resin. Examples of other resins include alkyd resins, polybutyral resins, polyolefins, ethylenevinyl acetate copolymers, styrene resins, styrenebutadiene resins, acrylate-butadiene resins, and vinyl alkanoate resins.

However, the content of these other resins should be less than about 30% by weight of the total binder resins since, if the content of other resins exceeds about 30%, the effect (in particular, the improvement of electrostatic characteristics) of the present invention cannot be obtained.

The compounding ratio of the resin (A) to any of the resins (C) to (E) varies depending upon the type of an inorganic photoconductive substance to be used, the particle sizes of the photoconductive substance, and the surface state thereof, but is generally from 5 to 80/95 to 20 by weight, and preferably from 15 to 60/85 to 40 by weight.

The ratio of the weight average molecular weight of the resin (C), (D), or (E) to that of the resin (A) is preferably 1.2 or more, and more preferably 2.0 or more.

The inorganic photoconductive substance used in the present invention include zinc oxide, titanium oxide, zinc sulfide, cadmium sulfide, cadmium carbonate, zinc selenide, cadmium selenide, tellurium selenide, lead sulfide, etc. Of these substances, zinc oxide is particularly preferred.

The total proportion of the binder resins for the photoconductive layer in the present invention is from 10 to 100 parts by weight, and preferably from 15 to 50 parts by weight per 100 parts by weight of the photoconductive substance.

In the present invention, various kinds of dyes can be used, if necessary, for the photoconductive layers as spectral sensitizers. Examples of these dyes are carbonium series dyes, diphenylmethane dyes, triphenylmethane dyes, xanthene series dyes, phthalein series dyes, polymethine dyes (e.g., oxonol dyes, merocyanine dyes, cyanine dyes, rhodacyanine dyes, and styryl dyes), and phthalocyanine dyes (inclusive of metallized dyes) described in Harumi Miyamoto and Hidehiko Takei, *Imaging*, 1973, (No. 8), page 12, C.J. Young, et al, *RCA Review*, 15, 469 (1954), Kohei Kiyoda, *Journal of Electric Communication Society of Japan*, J 63 C (*No.* 2), 97 (1980), Yuji Harasaki et al, *Kogyo Kagaku Zasshi*, 66, 78 and 188 (1963), and Tadaaki Tani, *Journal of the Society of Photographic Science and Technology of Japan*, 35, 208 (1972).

Specific examples of suitable carbonium series dyes, triphenylmethane dyes, xanthene series dyes, and phthalein series dyes are described in JP-B-51-452, JP-A-50-90334, JP-A-50-114227, JP-A-53-39310, JP-A-53-82353, and JP-A-57-16455, and U.S. Pat. Nos. 3,052,540 and 4,054,450.

Also, polymethine dyes such as oxonol dyes, merocyanine dyes, cyanine dyes, and rhodacyanine dyes which can be used are described in F.M. Harmmer, *The Cyanine Dyes and Related Compounds*, and specific examples thereof include the dyes disclosed in U.S. Pat. Nos. 3,047,384, 3,110,591, 3,212,008, 3,125,447, 3,128,179, 3,132,942, and 3,622,317, British Patents 1,226,892, 1,309,274, and 1,405,898, and JP-B-48-7814 and JP-B-

55-18892. (The term "JP-B" as used herein means an "examined Japanese patent publication".)

Furthermore, polymethine dyes capable of spectrally sensitizing in the wavelength region of from near infrared to infrared longer than 700 nm are described in JP-B-51-41061, JP-A-47-840, JP-A-47-44180, JP-A-49-5034, JP-A-49-45122, JP-A-57-46245, JP-A-56-35141, JP-A-57-157254, JP-A-61-26044, and JP-A-61-27551, U.S. Pat. Nos. 3,619,154 and 4,175,956, and *Research Disclosure,* 216, 117 to 118 (1982).

The light-sensitive material of the present invention is excellent in that, even when various sensitizing dyes are used for the photoconductive layer, the performance thereof is reluctant to vary by such sensitizing dyes.

If desired, the photoconductive layers may further contain various additives commonly employed in electrophotographic photoconductive layers, such as chemical sensitizers. Examples of such additives are electron-acceptive compounds (e.g., halogen, benzoquinone, chloranil, acid anhydrides, and organic carboxylic acids) described in *Imaging,* 1973, (No. 8), page 12, and polyarylalkane compounds, hindered phenol compounds, and p-phenylenediamine compounds described in Hiroshi Kokado, *Recent Photoconductive Materials and Development and Practical Use of Light-sensitive Materials,* Chapters 4 to 6, published by Nippon Kagaku Joho K.K., 1986.

There is no particular restriction on the amount of these additives but the amount thereof is usually from 0.0001 to 2.0 parts by weight per 100 parts by weight of the photoconductive substance.

The thickness of the photoconductive layer is from 1 μm to 100 μm, and preferably from 10 μm to 50 μm.

Also, when the photoconductive layer is used as a charge generating layer of a double layer type electrophotographic light-sensitive material having the charge generating layer and a charge transporting layer, the thickness of the charge generating layer is from 0.01 μm to 1 μm, and preferably from 0.05 μm to 0.5 μm.

If desired, an insulating layer can be formed on the photoconductive layer for the protection of the photoconductive layer and for the improvement of the durability and the dark decay characteristics of the photoconductive layer. In this case, the thickness of the insulating layer is relatively thin but, when the light-sensitive material is used for a specific electrophotographic process, the insulating layer having a relatively thick thickness is formed.

In the latter case, the thickness of the insulating layer is from 5 μm to 70 μm, and particularly from 10 μm to 50 μm.

Charge transporting materials which are used for the double layer type light-sensitive material include polyvinylcarbazole, oxazole series dyes, pyrazoline series dyes, and triphenylmethane series dyes. The thickness of the charge transfer layer is from 5 μm to 40 μm, and preferably from 10 μm to 30 μm.

Resins which can be used for the insulating layer and the charge transfer layer typically include thermoplastic and thermosetting resins such as polystyrene resins, polyester resins, cellulose resins, polyether resins, vinyl chloride resins, vinyl acetate resins, vinyl chloride-vinyl acetate copolymer resins, polyacryl resins, polyolefin resins, urethane resins, epoxy resins, melamine resins, and silicone resins.

The photoconductive layer of the present invention can be formed on a conventional support. In general, the support for the electrophotographic light-sensitive material is preferably electroconductive. As the conductive support, there are base materials such as metals, papers, plastic sheets, etc., rendered electroconductive by the impregnation of a low resistance material, the base materials in which the back surface thereof (the surface opposite to the surface of forming a photoconductive layer) is rendered electroconductive and having coated with one or more layer for preventing the occurrence of curling of the support, the aforesaid support having formed on the surface a water resistance adhesive layer, the aforesaid layer having formed on the surface at least one precoat, and a support formed by laminating thereon a plastic film rendered electroconductive by vapor depositing thereon an aluminum, etc.

Practical examples of electroconductive base materials and conductivity-imparting materials are described in Yukio Sakamoto, *Denshi Shashin* (*Electrophotography*), 14 (No. 1), 2 to 11 (1975), Hiroyuki Moriga, *Chemistry of Specific Papers,* published by Kobunshi Kanko Kai, 1975, M.F. Hoover, *J. Macromol. Sci. Chem.*, A to 4 (6), 1327–1417 (1970).

In order to produce the electrophotographic light-sensitive material according to the present invention, an inorganic photoconductive substance, a binder resin containing at least the resin (A) defined above, an appropriate solvent, and, optionally, various additives generally used in electrophotographic light-sensitive materials such as sensitizing agent, etc. are mixed in a usual manner to prepare a dispersion for forming a photoconductive layer, the resulting dispersion is then coated on an electroconductive support directly or through appropriate layer(s) such as an intermediate layer or a subbing layer by a conventional coating method such as a wire bar coating method, and the coated layer is dried to obtain an electrophotographic light-sensitive material.

The following examples are intended to illustrate the present invention, but the present invention is not limited thereto.

Production Example 1 of Resin (A): (A-1)

A mixed solution of 95 g of ethyl methacrylate, 5 g of thioglycolic acid, 2 g of divinylbenzene and 200 g of toluene was heated to 75° C. with stirring under nitrogen gas stream and, after adding thereto 1.5 g of azobisisobutyronitrile (A.I.B.N.), the reaction was carried out for 4 hours. Then, 0.8 g of A.I.B.N. was added to the reaction mixture, followed by reaction for 3 hours and, thereafter, 0.5 g of A.I.B.N. was added thereto, followed by reacting for 3 hours. The resulting copolymer had a weight average molecular weight (Mw, hereinafter the same) was $8.3\times10^3$.

Production Example 2 of Resin (A): (A-2)

A mixed solution of 95 g of benzyl methacrylate, 1.5 g of ethylene glycol dimethacrylate, 1.0 g of n-dodecylmercaptan, 150 g of toluene and 50 g of isopropyl methacrylate was heated to 85° C. under a nitrogen stream. 5.0 g of 4,4'-azobis(4-cyanovaleric acid) (A.C.V.) was added while stirring, and the mixture was reacted for 5 hours. Then, 1 g of A.C.V. was added thereto, and the mixture was reacted for 4 hours. The resulting copolymer had a Mw of $7.5\times10^3$.

Production Examples 3 to 25 of Resin (A): (A-3) to (A-25)

Each of the copolymers was prepared in the same manner as described in Production Example 1 of Resin (A), except for using the compounds shown in Table 1 below instead of ethyl methacrylate, thioglycolic acid, and divinylbenzene, respectively, in the amounts shown in Table 1. Each of the resulting copolymer had a Mw in the range of from $5\times10^3$ to $9\times10^3$.

TABLE 1

| Resin (A) | Monomer | Chain Transfer Agent | Polyfunctional Monomer |
|---|---|---|---|
| A-3 | Methyl methacrylate (95 g) | β-Mercaptopropionic acid (5 g) | Divinylbenzene (2 g) |
| A-4 | Phenyl methacrylate (95 g) | Thiomalic acid (5 g) | " |
| A-5 | Ethyl methacrylate (95 g) | Thiosalicylic acid (5 g) | " |
| A-6 | 2-Chlorophenyl methacrylate (96 g) | Thioglycolic acid (4 g) | Ethylene glycol dimethacrylate (2.5 g) |
| A-7 | 2,6-Dichlorophenyl methacrylate (97 g) | Thiosalicylic acid (3 g) | Divinylbenzene (2.5 g) |
| A-8 | 1-Naphthyl methacrylate (96 g) | 2-Mercaptoethylphosphonic acid (4 g) | Diethylene glycol diacrylate (2.8 g) |
| A-9 | 2-Chloro-6-methylphenyl methacrylate (96 g) | β-Mercaptopropionic acid (4 g) | Trivinylbenzene (1.5 g) |
| A-10 | 2-Bromophenyl methacrylate (94 g) | 2-(2-Mercaptoethyl)maleic acid anhydride (6 g) | Propylene glycol diacrylate (2.2 g) |
| A-11 | Methyl methacrylate (53 g) Butyl methacrylate (40 g) | 2-(2-Mercaptoethylcarbamoyl)-propionic acid (7 g) | Ethylene glycol diacrylate (2.0 g) |
| A-12 | Ethyl methacrylate (84 g) 2-Hydroxyethyl methacrylate (10 g) | Thiosalicylic acid (6 g) | Divinylbenzene (3 g) |
| A-13 | Benzyl methacrylate (87 g) Glycidyl methacrylate (8 g) | Thioglycolic acid (5 g) | Propylene glycol dimethacrylate (2.6 g) |
| A-14 | 2-Chlorophenyl methacrylate (88 g) 2,3-Dihydroxypropyl methacrylate (8 g) | β-Mercaptopropionic acid (4 g) | Divinylbenzene (2 g) |
| A-15 | Phenyl methacrylate (87 g) 2-Isocyanatoethyl methacrylate (5 g) | 3-(2-Mercaptoethylcarbamoyl)-phthalic acid anhydride (8 g) | Divinylbenzene (2 g) |
| A-16 | Benzyl methacrylate (86 g) 6-Hydroxyhexyl methacrylate (10 g) | Thiomalic acid (4 g) | Triethylene glycol diacrylate (1.8 g) |
| A-17 | 2-Acetylphenyl methacrylate (96 g) | 3-(2-Mercaptoethyloxycarbonyl)-phthalic acid (4 g) | Vinyl methacrylate (2.5 g) |
| A-18 | 2-Naphthylmethyl methacrylate (96 g) | Thiosalicylic acid (4 g) | Divinylbenzene (2.2 g) |
| A-19 | 2-Chlorophenyl methacrylate (86 g) Glycidyl methacrylate (10 g) | β-Mercaptopropionic acid (4 g) | Ethylene glycol dimethacrylate (2.6 g) |
| A-20 | Phenethyl methacrylate (95 g) | β-Mercaptopropionic acid (5 g) | Ethylene glycol dimethacrylate (2.8 g) |
| A-21 | 2-Chlorophenyl methacrylate (84 g) Methyl acrylate (10 g) | Thiosalicylic acid (6 g) | Divinylbenzene (3 g) |
| A-22 | 2-Acetylphenyl methacrylate (95 g) | Thioglycolic acid (5 g) | Propylene glycol dimethacrylate (2.6 g) |
| A-23 | 2-Chlorophenyl methacrylate (88 g) Glycidyl methacrylate (8 g) | β-Mercaptopropionic acid (4 g) | Divinylbenzene (2 g) |
| A-24 | 2-Chloro-6-methylphenyl methacrylate (96 g) | 3-(2-Mercaptoethyloxy-carbonyl)phthalic acid (4 g) | Vinyl methacrylate (2.5 g) |
| A-25 | 2,6-Dichlorophenyl methacrylate (86 g) Ethyl methacrylate (10 g) | β-Mercaptopropionic acid (4 g) | Ethylene glycol dimethacrylate (2.6 g) |

Production Example 21 of Resin (A): (A-26)

A mixed solution of 95 g of 2-chlorophenyl methacrylate, 5 g of 2-mercaptoethanol, 2.3 g of divinylbenzene and 200 g of toluene was heated to 75° C. under a nitrogen stream. While stirring, 2 g of azobis-(isovaleronitrile) (A.I.V.N.) was added thereto, and the mixture was reacted for 4 hours, and then 0.8 g of A.I.V.N. was added thereto, and the mixture was reacted for 3 hours. Further, 0.8 g of A.I.V.N. was added thereto, followed by reacting for 3 hours.

8 g of succinic acid anhydride and 1 g of pyridine were added to the reaction mixture, and the resulting mixture was stirred at a temperature of 100° C. for 6 hours. After cooling, the mixture was reprecipitated in 1 liter of a methanol solution containing 20% by volume of water, and the precipitates were collected. The yield of the product after drying under reduced pressure was 65 g, and the product had a Mw of $7.5\times10^3$.

Production Example 27 of Resin (A): (A-27)

A mixed solution of 76 g of 2-bromophenyl methacrylate, 20 g of the monomer (A) shown below, 4 g of thioglycolic acid, 4 g of divinylbenzene and 200 g of toluene was heated to 80° C. in a nitrogen stream. Then, 2 g of A.I.B.N. was added thereto, and the a mixture was reacted for 4 hours. Further, 0.5 g of A.I.B.N. was added to the mixture, followed by reacting for 3 hours. The resulting product had a Mw of $8.5\times10^3$.

Monomer (A)

-continued

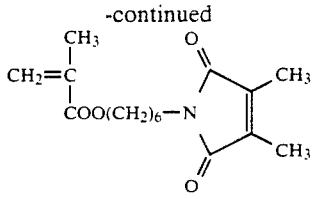

Production Example 28 of Resin (A): (A-28)

A mixed solution of 66.5 g of 2-chloro-6-methylphenyl methacrylate, 30 g of the monomer (B) shown below, 3.5 g of thioglycolic acid, 3 g of divinylbenzene and 200 g of toluene was reacted in the same manner as Production Example 27. The resulting copolymer had a Mw of $9\times10^3$.

Monomer (A)

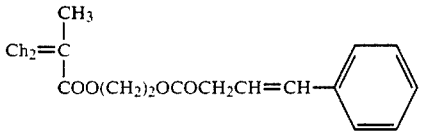

EXAMPLE 1

A mixture of 40 g (as solid content) of the resin (A-1) produced in Production Example 1 of Resin (A), 200 g of zinc oxide, 0.02 g of a heptamethine cyanine dye (A) having the structure shown below, 0.02 g of phthalic anhydride, and 300 g of toluene was dispersed in a ball mill for 3 hours to prepare a coating composition for a photoconductive layer. The composition was coated on a paper, which had been subjected to an electroconductive treatment, by a wire bar in a dry coated amount of 22 g/m$^2$ and dried for 1 minute at 110° C. The coated product was allowed to stand in the dark for 24 hours under conditions of 20° C., 65% RH to obtain an electrophotographic light-sensitive material.

Dye (A):

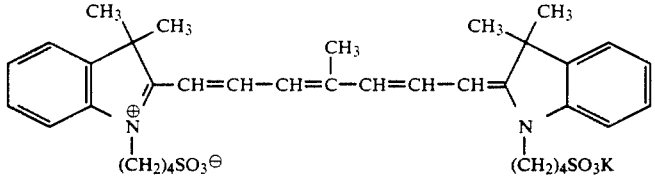

EXAMPLE 2

An electrophotographic light-sensitive material was prepared in the same manner as Example 1, except that 40 g (as solid content) of Resin (A-6) was used in place of the resin (A-1).

COMPARATIVE EXAMPLE A-1

An electrophotographic light-sensitive material was prepared in the same manner as Example 1, except that 40 g of an ethyl methacrylate/acrylic acid (95/5 weight ratio) copolymer (R-1) having a Mw of $8.5\times10^3$ was used instead of the Resin (A-1).

COMPARATIVE EXAMPLE B-1

An electrophotographic light sensitive material was prepared in the same manner as Example 1, except that 40 g of the Resin (R-2) having the following structure formula was used in place of the Resin (A-1).

(R-2)

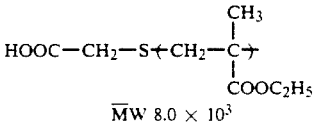

COMPARATIVE EXAMPLE C-1

An electrophotographic light-sensitive material was prepared in the same manner as Example 1, except that 40 g of the Resin (R-3) having the following structure formula was used in place of the Resin (A-1).

(R-3)

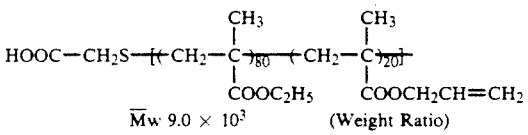

On these light-sensitive materials, electrostatic characteristics, image forming performance under atmospheric condition, and image forming performance under the conditions of 30° C., 80% RH were measured. The results obtained are shown in Table 2 below.

TABLE 2

| | Example 1 | Example 2 | Comparative Example A-1 | Comparative Example B-1 | Comparative Example C-1 |
|---|---|---|---|---|---|
| Electrophotographic*1) Characteristics | | | | | |
| $V_{10}$ (−V) | | | | | |
| I: (20° C., 65%) | 510 | 590 | 450 | 450 | 450 |
| II: (30° C., 80%) | 505 | 575 | 410 | 430 | 425 |
| DRR (%) (90 sec) | | | | | |
| I: (20° C., 65%) | 75 | 85 | 75 | 80 | 78 |
| II: (30° C., 80%) | 70 | 83 | 70 | 75 | 75 |
| $E_{1/10}$ (erg/cm$^2$) | | | | | |
| I: (20° C., 65%) | 28 | 18 | 70 | 30 | 35 |

TABLE 2-continued

| | Example 1 | Example 2 | Comparative Example A-1 | Comparative Example B-1 | Comparative Example C-1 |
|---|---|---|---|---|---|
| II: (30° C., 80%) | 25 | 17 | 85 | 28 | 30 |
| Image Forming*2) Performance | | | | | |
| I: (20° C., 65%) | Good | Excellent | Background fog generated, Dm lowered | Dm lowered | Dm lowered |
| II: (30° C., 80%) | Good | Excellent | Background fog generated markedly | Dm lowered, densities of fine lines decreased | Background fog generated markedly |

The evaluation items shown in Table 2 above were conducted as follows.

*1) Electrostatic Characteristics

Each light-sensitive material was charged by applying thereto corona discharging of −6 kV for 20 seconds using a paper analyzer (Paper Analyzer Type SP-428, manufactured by Kawaguchi Denki K.K.) in the dark at 20° C., 65% RH and then allowed to stand for 10 seconds. The surface potential $V_{10}$ in this case was measured. Then, the sample was allowed to stand for 90 seconds in the dark and then the potential $V_{100}$ was measured. The dark decay retention [DRR (%)], i.e., the percent retention of potential after decaying for 120 seconds in the dark, was calculated from the following formula:

$$DRR\ (\%) = (V_{100}/V_{10}) \times 100$$

Also, the surface of the photoconductive layer was charged to −400 volts by corona discharging, then irradiated by monochromatic light of a wavelength of 780 n.m., the time required for decaying the surface potential $V_{10}$ to 1/10 thereof, and the exposure amount $E_{1/10}$ (erg/cm$^2$) was calculated therefrom.

*2) Imaging Forming Performance

Each light-sensitive material was allowed to stand a whole day and night under the environmental condition (I) of 20° C., 65% RH or the environmental condition (II) of 30° C., 80% RH. Then, each sample was charged to −5 kV, exposed by scanning with a gallium-aluminum-arsenic semiconductor laser (oscillation wavelength 780 n.m.) of 2.8 mW in output as a light source at an exposure amount on the surface of 64 erg/cm$^2$, at a pitch of 25 m, and a scanning speed of 300 m/sec., and developed using ELP-T (trade name, made by Fuji Photo Film Co., Ltd.) as a liquid developer followed by fixing. Then, the reproduced images (fog, image quality) were visually evaluated.

The above measurements were conducted under Condition I (20° C., 60% RH) and Condition II (30° C., 80% RH).

As shown in Table 2, it can be seen that the light-sensitive material of the present invention was excellent in electrostatic characteristics as well as the reproduced images formed by processing had no background stains and had clear image quality.

On the other hand, in the case of the light-sensitive material of Comparative Example A-1 where the copolymer used as a binder resin has a low weight average molecular weight of about $8 \times 10^3$ similar to that of the Resin (A) of the present invention, but contains a carboxyl group-containing component randomly, the light-sensitive material of Comparative Example B-1 where the copolymer used as a binder resin contains a carboxyl group only at the terminal of the polymer main chain, but has no crosslinked structure, and the light-sensitive material of Comparative Example C-1 where the copolymer used as a binder resin contains a curable functional group, the charging potential ($V_{10}$) and the light sensitivity ($E_{1/10}$) were reduced, and the reproduced image showed the decreased image sensitivity (Dm) thereby generating cut of fine lines and letters, and background stains.

Thus, only the light-sensitive materials according to the present invention were found to have satisfactory electrostatic characteristics.

Further, it was confirmed that, in the case of using the resins according to the present invention, the resin (A) containing a methacrylate component having a specific substituent (Example 2) has an improved electrostatic characteristics over the resin of Example 1 and is more preferred particularly as a light-sensitive material for the scanning exposure system using a semiconductor laser beam.

EXAMPLE 3 AND COMPARATIVE EXAMPLE D-1

A mixture of 10 g (as solid component) of the resin (A-19) produced in Production Example 19, 30 g of the resin (B-1) having the following formula, 200 g of zinc oxide, 0.018 g of a cyanine dye (B) having the structure shown below, 0.30 g of phthalic anhydride, and 300 g of toluene was dispersed in a ball mill for 3 hours, and after adding thereto 4 g of glutaconic acid, the mixture was dispersed for 10 minutes in a ball mill. The resulting dispersion was coated on a paper, which had been subjected to an electroconductive treatment, by a wire bar at a dry coated amount of 22 g/m$^2$, dried for 30 seconds at 100° C. and then heated for 1 hour at 120° C. Then, the coated product was allowed to stand for 24 hours under the condition of 20° C., 65% RH to obtain an electrophotographic light-sensitive material.

Cyanine Dye (B):

-continued

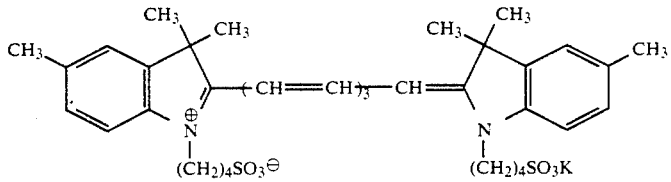

Resin (B-1)

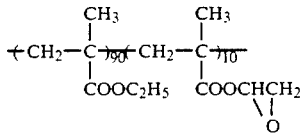

Mw = $5.0 \times 10^4$ (weight ratio)

COMPARATIVE EXAMPLE D-1

An electrophotographic light-sensitive material was prepared in the same manner as Example 3, except that 10 g of the resin (R-4) having the following formula was used in place of 10 g of the resin (A-19).

(R-4)

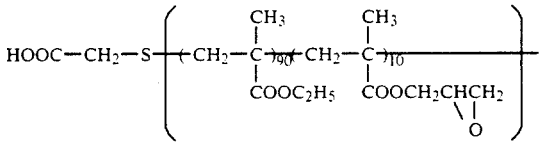

Mw = $8.5 \times 10^3$ (weight ratio)

On these light-sensitive materials, the coating property (surface smoothness), film strength, electrostatic characteristics, image forming performance under atmospheric condition, and image forming performance under the environmental condition of 30° C., 80% RH were determined. Furthermore, each sample was used as an offset master plate after processing, and the desensitizing property of the photoconductive layer (shown by the contact angle between oil-desensitized photoconductive layer and water) and the printing properties (background stains, printing durability, etc.) were determined.

The results obtained are shown in Table 3 below.

TABLE 3

| | Example 3 | Comparison Example D-1 |
|---|---|---|
| Smoothness of Photo-*3) conductive Layer (sec/cc) | 130 | 130 |
| Strength of Photo-conductive Layer (%) | 95 | 93 |
| Electrophotographic*4) Characteristics | | |
| $V_{10}$ (-V) | | |
| I: (20° C., 65%) | 570 | 445 |
| II: (30° C., 80%) | 555 | 430 |
| DRR (%) | | |
| I: (20° C., 65%) | 83 | 70 |
| II: (30° C., 80%) | 80 | 65 |
| $E_{1/10}$ (erg/cm$^2$) | | |
| I: (20° C., 65%) | 18 | 33 |
| II: (30° C., 80%) | 18 | 38 |
| Image Forming*5) Performance | | |

TABLE 3-continued

| | Example 3 | Comparison Example D-1 |
|---|---|---|
| I: (20° C., 65%) | very good | Dm lowered, densities of fine line and letter lowered |
| II: (30° C., 80%) | very good | Dm lowered, densities of fine line and letter lowered, background stain generated slightly. |
| Contact Angle*6) with Water (°C.) | 10 or below | 10 or below |
| Printing Durability*7) | 10,000 prints | 3,000 prints, cut of fine line and letter occurred |

The evaluation shown in Table 3 above were conducted as follows.

*3) Smoothness of Photoconductive Layer

The smoothness (sec/cc) of each light-sensitive material was measured using a Beck Smoothness Test Machine (manufactured by Komagaya Riko K.K.) under an air volume of 1 cc.

*4) Electrostatic Characteristics

Each light-sensitive material was charged by applying thereto corona discharging of −6 kV for 20 seconds using a paper analyzer (Paper Analyzer Type SP-428, manufactured by Kawaguchi Denki K.K.) in the dark at 20° C., 65% RH and then allowed to stand for 10 seconds. The surface potential $V_{10}$ in this case was measured. Then, the sample was allowed to stand for 120 seconds in the dark and then the potential $V_{130}$ was measured. The dark decay retention [DRR (%)], i.e., the percent retention of potential after decaying for 120 seconds in the dark, was calculated from the following formula:

$$DRR\ (\%) = (V_{130}/V_{10}) \times 100$$

Also, the surface of the photoconductive layer was charged to −400 volts by corona discharging, then irradiated by monochromatic light of a wavelength of 780 n.m., the time required for decaying the surface potential $V_{10}$ to 1/10 thereof, and the exposure amount $E_{1/10}$ (erg/cm$^2$) was calculated therefrom.

The measurements were conducted under Condition I (20° C., 60% RH) and Condition II (30° C., 80% RH).

*5) Image Forming Performance

Each light-sensitive material was allowed to stand a whole day and night under the environmental condition (I) of 20° C., 65% RH or the environmental condition (II) of 30° C., 80% RH. Then, each sample was charged to −5 kV, exposed by scanning with a gallium-aluminum-arsenic semiconductor laser (oscillation wavelength 780 n.m.) of 2.8 mW in output as a light source at an exposure amount on the surface of 56 erg/cm$^2$, at a pitch of 25 μm, and a scanning speed of 280 m/sec., and developed using ELP-T (trade name, made by Fuji Photo Film Co., Ltd.) as a liquid developer followed by fixing. Then, the reproduced images (fog, image quality) were visually evaluated.

*6) Contact Angle with Water

Each light-sensitive material was passed once through an etching processor using a solution prepared by diluting a oil-desensitizing solution ELP-E (trade name, made by Fuji Photo Film Co., Ltd.) two-times with distilled water to desensitized the surface of the photoconductive layer. Then, one drop of distilled water (2 μl) was placed on the surface, and the contact angle between the surface and the water drop formed thereon was measured using a goniometer.

*7) Printing Durability

Each light-sensitive material was processed in the same manner as described in *5), the sample was oil-desensitized under the dame condition as in *6) described above, and the printing plate thus prepared was mounted on an offset printing machine (Oliver Model 52, manufactured by Sakurai Seisakusho K.K.) as an offset master plate following by printing. Then, the number of prints obtained without causing background staining on the non-imaged portions of prints and problems on the quality of the imaged portions was employed as the printing durability. The larger the number of prints, the higher the printing durability.

As shown in Table 3, it can be seen that the light-sensitive material of the present invention was excellent in the smoothness of the photoconductive layer, the mechanical strength of the film, and electrostatic characteristics, and the reproduced images formed by processing had no background stains and had clear image quality. This is assumed to be based on that the binder resin suitably adsorbed on the photoconductive particles and suitably covered the surface of the particles as well as did not hinder the adsorption of spectral sensitizing dyes onto the particles.

When the light-sensitive material was used as an offset master plate after processing, the photoconductive layer was sufficiently oil-desensitized by an oil-desensitizing solution for the same reason as above, and the contact angle between the non-image area and water was as low as below 15 degrees, which showed that the layer was sufficiently rendered hydrophilic. At printing, no background staining of prints was observed.

The above results indicate that the film strength is markedly improved by the action of the resin (B) or the resin (B) plus the crosslinking agent without adversely affecting the effect of the resin (A).

On the other hand, in the light-sensitive material of Comparative Example D-1 using the resin (R-4) which contains a curable functional group but does not have a crosslinked structure, electrostatic characteristics are lowered as compared with those of the present light-sensitive material. In particular, difference in D.R.R. is remarkable when the measurement condition is prolonged to 1.5 times the condition used in Example 1. Actually, the reproduced image obtained by a prolonged scanning exposure using a low output semiconductor laser beam was not satisfactory in its image quality.

When the light-sensitive material of Comparative Example D-1 was used as an offset master plate after processing, the photoconductive layer was sufficiently oil-desensitized by an oil-desensitizing solution, and the content angle between the non-image area and water was as low as below 10 degrees, which showed that the layer was sufficiently rendered hydrophilic. Actually, on printing, no background stains were observed in the non-image portion of the prints. However, due to unsatisfactory image quality of the reproduced image, the maximum number of prints was about 3,000, and cut of letter or fine lines were generated.

EXAMPLE 4

A mixture of 38 g (as solid component) of the resin (A-14) produced in Production Example 14 of Resin (A), 200 g of zinc oxide, 0.02 g of a methine dye (C) having the structure shown below, 0.30 g of maleic anhydride, and 300 g of toluene was dispersed in a ball mill for 2 hours and, after adding thereto 4 g of 1,3-xylylene diisocyanate, the resulting mixture was dispersed for 10 minutes in the ball mill.

The dispersion was coated on a paper, which had been subjected to an electroconductive treatment, by a wire bar in a dry coating amount of 22 g/m$^2$ and dried for 15 seconds at 100° C. and then for 2 hours at 120° C. Then, the coated product was allowed to stand for 24 hours under the condition of 20° C., 65% RH to obtain an electrophotographic light-sensitive material.

Methine Dye (C):

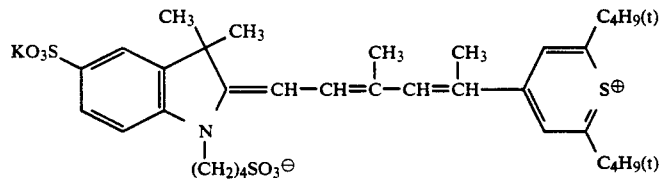

The properties of the resulting material were measured in the same manner as described in Example 3, and the results obtained are shown in Table 4 below.

TABLE 4

| | |
|---|---|
| Smoothness of Photoconductive Layer | 135 (sec/cc) |
| Strength of Photoconductive Layer (%) | 92 |
| Electrophotographic Characteristics | |

TABLE 4-continued

| | | |
|---|---|---|
| $V_{10}$ (-V) | I | 565 (V) |
| | II | 560 (V) |
| D.R.R. (%) | I | 82% |
| (120 sec value) | II | 80% |
| $E_{1/10}$ | I | 20 |
| (erg/cm$^2$) | II | 21 |
| Image Forming | I | very good |
| performance | II | very good |
| Printing Durability | | 10,000 |

EXAMPLES 5 TO 12

Each of electrophotographic light-sensitive materials was prepared in the same manner as Example 3, except that the resins and the crosslinking agent shown in Table 5 below were used in place of 10 g of the resin (A-19), 30 g of the resin (B-1) and 4 g of glutaconic acid as a crosslinking agent, and that 0.02 g of the cyanine (D) having the following structure was used in place of the cyanine dye (B).

Cyanine Dye (D):

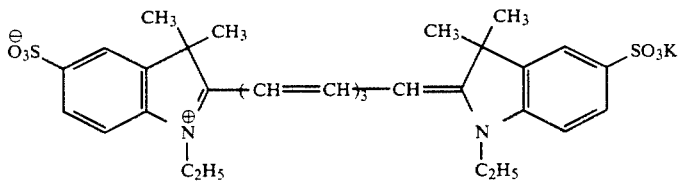

The properties of the resulting materials were measured in the same manner as described in Example 3, and the results obtained are shown in Table 5 below.

TABLE 5
| Example | Resin (A) 10 g | Resin (B) 30 g | | Crosslinking Agent | | Electrostatic Characteristics (30° C., 80% RH) $V_{10}$ (−V) | D.R.R. (%) | $E_{1/10}$ (erg/cm$^2$) |
|---|---|---|---|---|---|---|---|---|
| 5 | A-2 | (B-2) 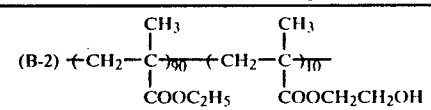 | $\overline{M}w$ 38,000 | 1,3-xylylenedi-isocyanate | 1.5 g | 550 | 80 | 23 |
| 6 | A-13 | (B-3) 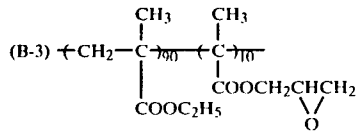 | $\overline{M}w$ 40,000 | 1,6-hexamethylene-diamine | 1.3 g | 550 | 78 | 26 |
| 7 | A-6 | (B-4) 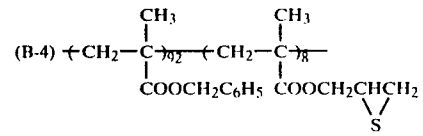 | $\overline{M}w$ 41,000 | Terephthalic acid | 1.5 g | 610 | 85 | 18 |
| 8 | A-7 | (B-5) 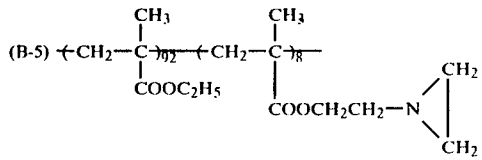 | $\overline{M}w$ 38,000 | 1,4-tetramethyl-enediamine | 1.2 g | 630 | 86 | 17 |
| 9 | A-15 | (B-6) 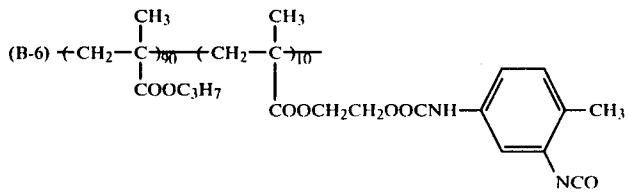 | $\overline{M}w$ 37,000 | polyethylene glycol | 1.2 g | 540 | 79 | 28 |
| 10 | A-9 | (B-6) 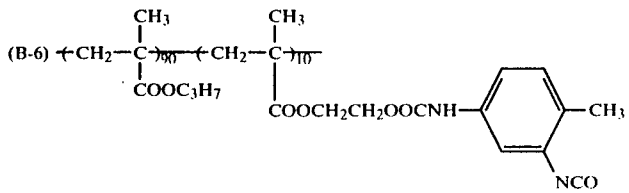 | | polypropylene glycol | 1.2 g | 580 | 85 | 18 |

TABLE 5-continued

| Example | Resin (A) 10 g | Resin (B) 30 g | | Crosslinking Agent | | Electrostatic Characteristics (30° C., 80% RH) $V_{10}$ (−V) | D.R.R. (%) | $E_{1/10}$ (erg/cm$^2$) |
|---|---|---|---|---|---|---|---|---|
| 11 | A-10 | (B-7) $\leftarrow CH_2-\underset{\underset{COOCH_3}{\mid}}{\overset{\overset{CH_3}{\mid}}{C}}\rightarrow_{45}\leftarrow CH_2-\underset{\underset{COOC_2H_5}{\mid}}{\overset{\overset{CH_3}{\mid}}{C}}\rightarrow_{40}\leftarrow CH_2-\underset{\underset{COO(CH_2)_6OH}{\mid}}{\overset{\overset{CH_3}{\mid}}{C}}\rightarrow_{15}$ | $\overline{M}w$ 42,000 | 1,6-hexamethylene-diisocyanate | 2 g | 565 | 83 | 20 |
| 12 | A-18 | (B-8) $\leftarrow CH_2-\underset{\underset{COOC_2H_5}{\mid}}{\overset{\overset{CH_3}{\mid}}{C}}\rightarrow_{80}\leftarrow CH_2-\underset{\underset{COOCH_2CH_2COOCH=CH_2}{\mid}}{\overset{\overset{CH_3}{\mid}}{C}}\rightarrow_{20}$ | $\overline{M}w$ 55,000 | ethyleneglycol-dimethacrylate | 2 g | 560 | 84 | 20 |

As shown in Table 5, the light-sensitive materials of the present invention were excellent in the charging property, the dark charge retentivity and the light sensitivity, and the reproduced images formed by processing showed clear images having no background stains and cut of fine lines. When the light-sensitive material was used as an offset master plate after processing, more than 8,000 prints having clear images without background stains could be obtained on printing.

EXAMPLES 13 TO 16

A mixture of 8 g of the resin (A) shown in Table 6, 20 g of the resin (B) in Group X shown in Table 6, 200 g of zinc oxide, 0.018 g of the above-described cyanine dye (A), 0.30 g of maleic anhydride, and 300 g of toluene was dispersed in a ball mill for 3 hours.

To the dispersion was added 12 g of the resin (B) in Group Y shown in Table 5, and the mixture was further dispersed in a ball mill for 10 minutes. The dispersion was coated on a paper, which had been subjected to an electroconductive treatment, by a wire bar in a dry coating amount of 20 g/m$^2$ and dried for 15 seconds at 100° C. and then heated for 2 hours at 120° C. Then, the coated material was allowed to stand for 24 hours under the conditions of 20° C, 65% RH to obtain each of electrophotographic light-sensitive materials.

TABLE 6

| Example | Resin (A) | Resin (B) Group X | | Resin (B) Group Y | |
|---|---|---|---|---|---|
| 13 | A-9 | (B-9) $\leftarrow CH_2-C(CH_3)(COOC_3H_7)\rightarrow_{90}\leftarrow CH_2-C(CH_3)(COOCH_2CH\underset{O}{\diagup\diagdown}CH_2)\rightarrow_{10}$ | $\overline{M}w$ = 42,000 | (B-10) $\leftarrow CH_2-C(CH_3)(COOC_3H_7)\rightarrow_{92}\leftarrow CH_2-C(CH_3)(COO(CH_2)_2NH_2)\rightarrow_{8}$ | $\overline{M}w$ = 38,000 |
| 14 | A-15 | (B-11) $\leftarrow CH_2-C(CH_3)(COOC_4H_9)\rightarrow_{90}\leftarrow CH_2-C(CH_3)(COO(CH_2)_2NCO)\rightarrow_{10}$ | $\overline{M}w$ = 45,000 | (B-10) | |
| 15 | A-17 | (B-12) $\leftarrow CH_2-C(CH_3)(COOC_2H_5)\rightarrow_{88}\leftarrow CH_2-C(CH_3)(COO(CH_2)_{10}OH)\rightarrow_{12}$ | $\overline{M}w$ = 38,000 | (B-13) $\leftarrow CH_2-C(CH_3)(COOC_2H_5)\rightarrow_{85}\leftarrow CH_2-C(CH_3)(COO(CH_2)_2OOCNH-C_6H_3(CH_3)(NCO))\rightarrow_{15}$ | $\overline{M}w$ = 46,000 |
| 16 | A-18 | (B-10) | | (B-14) $(CH_2-C(CH_3)(COOC_4H_9))\rightarrow_{90}\leftarrow CH_2-C(CH_3)(COOCH_2CH_2OCO-C_6H_3(C(=O)-O-C(=O))))\rightarrow_{10}$ | $\overline{M}w$ = 33,000 |

Each of the light-sensitive materials was excellent in the charging property, dark charge retentivity, and light sensitivity and provided clear images having no background fog under severe conditions of 30° C., 80% RH at practical image formation.

Furthermore, the light-sensitive material was used for printing as an offset master plate after processing, 8,000 prints having clear images were obtained.

EXAMPLE 17

A mixture of 10 g of the resin (A-5), 18 g of the resin (B-15) having the following formula, 200 g of zinc oxide, 0.50 g of Rose Bengal, 0.25 g of tetrabromophenol blue, 0.30 g of uranine, 0.30 g of tetrahydrophthalic anhydride and 240 g of toluene was dispersed in a ball mill for 2 hours. To the dispersion was added 12 g of the resin (B-15) having the following formula, and the mixture was dispersed for 10 minutes.

The dispersion was coated on a paper, which had been subjected to an electroconductive treatment, by a wire bar in a dry coating amount of 20 g/m$^2$, dried for 30 seconds at 110° C. and then heated for 2 hours at 120° C. The coated product was allowed to stand for 24 hours in the dark under conditions of 20° C., 65% RH to obtain an electrophotographic light-sensitive material.

Resin (B-15)

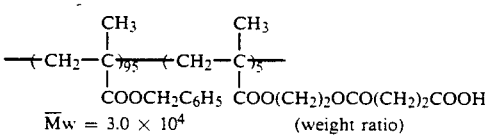

As in Example 1, the characteristics of the sample were measured.

The results obtained are as follows.

Smoothness of Photoconductive Layer: 125 (cc/sec.)

Strength of Photoconductive Layer: 95%

Electrostatic characteristics:

| | $V_{10}$ (V) | D.R.R. (%) | $E_{1/10}$ (lux · sec) |
|---|---|---|---|
| I (20° C., 65% RH): | −555 | 94 | 9.2 |
| II (30° C., 80% RH): | −545 | 93 | 9.5 |

Imaging Forming Performance:

Good reproduced images were obtained under the condition of 20° C., 65% RH and the condition of 30° C., 80% RH.

Printing Durability:

10,000 prints having good images were obtained.

Thus, light-sensitive material having excellent electrophotographic characteristics and high printing durability could be obtained.

The above electrostatic characteristics and the image forming performance were determined as follows.

Electrostatic Characteristics

Each light-sensitive material was charged by applying thereto corona discharging of −6 kV for 20 seconds using a paper analyzer (Paper Analyzer Type SP-428, manufactured by Kawaguchi Denki K.K.) in the dark at 20° C., 65% RH and then allowed to stand for 10 seconds. The surface potential $V_{10}$ in this case was measured. Then, the sample was allowed to stand for 60 seconds in the dark and then the potential $V_{70}$ was measured. The dark decay retention [DRR (%)], i.e., the percent retention of potential after decaying for 60 seconds in the dark, was calculated from the following formula:

$$DRR\ (\%) = (V_{70}/V_{10}) \times 100$$

Also, the surface of the photoconductive layer was charged to −400 volts by corona discharging, then irradiated by visible light at 2.0 lux. Then, the time required for decaying the surface potential $V_{10}$ to 1/10 thereof was measured, and the exposure amount $E_{1/10}$ (lux·sec) was calculated therefrom.

Image Forming Performance

The light-sensitive material was processed for platemaking by an automatic printing plate precursor ELP 404V (made by Fuji Photo Film Co., Ltd.) using ELP-T as a toner to form a toner image.

EXAMPLES 18 AND 19

A mixture of 6.3 g of each of the resin (A-22) and (A-23), 33.7 g of each of the resins (B) shown in Table 7 below, 200 g of zinc oxide, 0.02 g of uranine, 0.04 g of Rose Bengal, 0.03 g of bromophenol blue, 0.40 g of phthalic anhydride and 300 g of toluene was dispersed in a ball mill for 2 hours to prepare a coating composition for a photoconductive layer. The composition was coated on a paper, which had been subjected to an electroconductive treatment, by a wire bar in a dry coating amount of 20 g/m$^2$ and dried for 1 minute at 110° C. The coated product was exposed by a high pressure mercury lamp for 3 minutes and allowed to stand in the dark for 24 hours under conditions of 20° C., 65% RH to obtain an electrophotographic light-sensitive material. The properties of the resulting light-sensitive material are shown in Table 8.

TABLE 7

| Example | Resin (A) | Resin (B) |
|---|---|---|
| 18 | A-22 | (B-16) 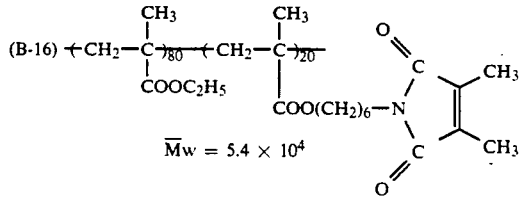 |

TABLE 7-continued

| Example | Resin (A) | Resin (B) |
|---|---|---|
| 19 | A-23 | 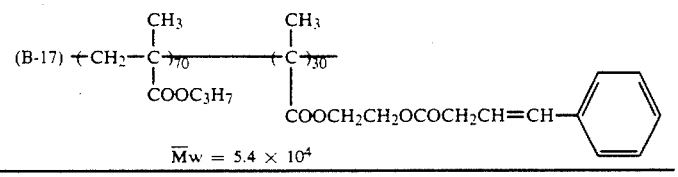 |

$\overline{M}w = 5.4 \times 10^4$

TABLE 8

| Example | Surface Smoothness (cc/sec) | Film Strength (%) | $V_{10}$ (-V) | D.R.R. (%) | $E_{1/10}$ (lux · sec) | Printing Durability |
|---|---|---|---|---|---|---|
| 18 | 125 | 97 | 565 | 93 | 10.5 | 9000 sheets |
| 19 | 130 | 94 | 570 | 94 | 10.8 | 8500 sheets |

Each of the light-sensitive materials of the present invention was excellent in the charging property, dark charge retentivity, and light-sensitivity and gave clear images having neither background fog nor fine line cutting even under severe conditions of high temperature and high humidity (30° C., 80% RH).

Furthermore, when each sample was used for printing as an offset master plate, 8,500 to 9,000 prints having clear images were obtained.

EXAMPLES 20 to 28

A mixture of 6.5 g of the resin (A) shown in Table 9 below and 33.5 g of the resin (B) shown in Table 9 below as a binder resin, 200 g of zinc oxide, 0.05 g of Rose Bengal, 0.03 g of tetrabromophenol blue, 0.02 g of uranine, 0.01 g of phthalic anhydride and 240 g of toluene was dispersed in a ball mill for 2 hours. To the dispersion was added the crosslinking agent shown in Table 8 below in the indicated amount, and the mixture was dispersed in the ball mill for 10 minutes. The dispersion was coated on a paper, which had been subjected to an electroconductive treatment, by a wire bar in a dry coating amount of 18 g/m$^2$ and dried for 30 seconds at 110° C. and then heated for 2 hours at 120° C. Then, the coated product was allowed to stand for 24 hours under the conditions of 20° C., 65% RH to prepare an electrophotographic light-sensitive material.

TABLE 9

| Example | Resin (A) | Resin (B) | Crosslinking Agent (Amount Added) |
|---|---|---|---|
| 20 | A-1 | B-1 | Glutaconic acid (4 g) |
| 21 | A-2 | B-2 | 1,3-Xylylene diisocyanate (3 g) |
| 22 | A-3 | B-6 | Ethylene glycol (1.5 g) |
| 23 | A-5 | B-8 | Ethylene glycol diacrylate (3 g) |
| 24 | A-11 | B-3 | Succinic acid (3.8 g) |
| 25 | A-12 | B-1 | None |
| 26 | A-16 | B-11 | None |
| 27 | A-20 | B-8 | 1,6-Hexane diisocyanate |

TABLE 9-continued

| Example | Resin (A) | Resin (B) | Crosslinking Agent (Amount Added) |
|---|---|---|---|
| 28 | A-21 | B-3 | Gluconic acid (3.8 g) |

The electrostatic characteristics of each light-sensitive material measured in the same manner as in Example 1 were excellent, and clear reproduced images having no background fog were obtained even under the high-temperature high-humidity condition (30° C., 80% RH). Also, when each light-sensitive material was used for printing as an offset master plate after processing, more than 8,000 prints having clear images could be obtained.

Examples 29 to 31 and Comparative Examples A-2 to F-2

EXAMPLE 29

A mixture of 6 g (as solid content) of the resin (A-7), 34 g (as solid content) of poly(ethyl methacrylate) ($Mw = 2.4 \times 10^5$; Resin (C-1)), 0.018 g of Cyanine Dye (I) having the following formula, 0.15 g of salicylic acid and 300 g of toluene was dispersed in a ball mill for 3 hours to prepare a coating composition for a photoconductive layer. The composition was coated on a paper, which had been subjected to an electroconductive treatment, by a wire bar in a dry coating amount of 20 g/m$^2$ and dried for 30 seconds at 110° C. Then, the coated product was allowed to stand for 24 hours in the dark under the conditions of 20° C., 65% RH to obtain each of the electrophotographic light-sensitive materials.

Cyanine Dye (I):

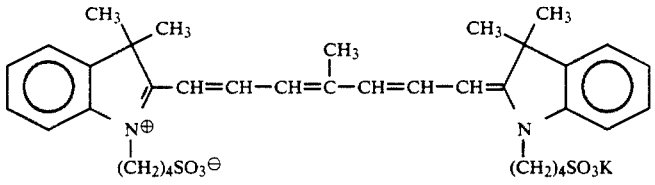

EXAMPLE 30

An electrophotographic light-sensitive material was prepared in the same manner as Example 29, except that 34 g of the resin (D-1) having the following formula was used in place of 34 g of the resin (C-1).

Resin (D-1)

-continued

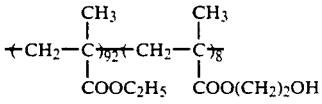

(weight ratio)

$\overline{M}w = 2.0 \times 10^5$

EXAMPLE 32

An electrophotographic light-sensitive material was prepared in the same manner as Example 29, except that 34 g of the resin (E-1) having the following formula was used in place of 34 g of the resin (C-1).

Resin (E-1)

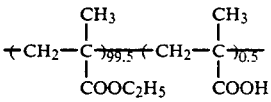

(weight ratio)

$\overline{M}w = 1.2 \times 10^5$

COMPARATIVE EXAMPLE A-2

An electrophotographic light-sensitive material was prepared in the same manner as Example 29, except that 6 g of the resin (R-1) having the following formula was used in place of 6 g of the binder resin (A-7) used in Example 29.

(R-1)

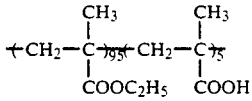

(weight ratio)

$\overline{M}w = 6.5 \times 10^3$

COMPARATIVE EXAMPLE B-2

An electrophotographic light-sensitive material was prepared in the same manner as Example 29, except that 6 g of the resin (R-2) having the following formula was used in place of 6 g of the binder resin (A-7) used in Example 29.

(R-2)

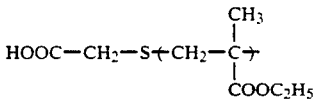

$\overline{M}w = 6.0 \times 10^3$

COMPARATIVE EXAMPLES C-2 to F-2

Each of the electrophotographic light-sensitive materials was prepared in the same manner as Example 29, except that the following resins were used as a binder resin:

Comparative Example C-2:
6 g of Resin (R-1) and 34 g of Resin (D-1)

Comparative Example D-2:
6 g of Resin (R-2) and 34 g of Resin (D-1)

Comparative Example E-2:
6 g of Resin (R-1) and 34 g of Resin (E-1)

Comparative Example F-2:
6 g of Resin (R-1) and 34 g of Resin (E-1)

On these light-sensitive materials, the coating property (surface smoothness), electrostatic characteristics, image forming performance under atmospheric condition, and image forming performance under the environmental condition of 30° C., 80% RH were determined.

Furthermore, each sample was used as an offset master plate after processing and the oil desensitizing property of the photoconductive layer (shown by the contact angle between oil desensitized photoconductive layer and water) and the printing properties (background stains, printing durability, etc.) were determined.

The results obtained are shown in Table 10 below.

TABLE 10

| | Example 29 | Example 30 | Example 31 | Comparative Example A-2 | Comparative Example B-2 | Comparative Example C-2 | Comparative Example D-2 | Comparative Example E-2 | Comparative Example F-2 |
|---|---|---|---|---|---|---|---|---|---|
| Smoothness of Photo-*1) conductive Layer (sec/cc) | 135 | 140 | 140 | 130 | 135 | 135 | 135 | 140 | 140 |
| Strength of Photo-*2) conductive Layer (%) | 85 | 92 | 98 | 83 | 84 | 90 | 91 | 97 | 98 |
| Electrophotographic*3) Characteristics | | | | | | | | | |
| $V_{10}$ (−V) | | | | | | | | | |
| I: (20° C., 65% RH) | 610 | 600 | 680 | 430 | 480 | 435 | 450 | 460 | 485 |
| II: (30° C., 80% RH) | 590 | 580 | 660 | 380 | 430 | 380 | 400 | 435 | 455 |
| DRR (%) | | | | | | | | | |
| I: (20° C., 65% RH) | 78 | 80 | 85 | 60 | 69 | 60 | 72 | 64 | 75 |
| II: (30° C., 80% RH) | 75 | 77 | 80 | 52 | 60 | 51 | 67 | 53 | 68 |
| $E_{1/10}$ (erg/cm$^2$) | | | | | | | | | |
| I: (20° C., 65% RH) | 35 | 33 | 30 | 62 | 53 | 60 | 50 | 48 | 43 |
| II: (30° C., 80% RH) | 38 | 35 | 32 | 55 | 46 | 53 | 45 | 43 | 40 |
| $E_{1/100}$ (erg/cm$^2$) | | | | | | | | | |
| I: (20° C., 65% RH) | 46 | 44 | 41 | 108 | 84 | 93 | 80 | 90 | 72 |
| II: (30° C., 80% RH) | 53 | 47 | 45 | 115 | 88 | 90 | 78 | 88 | 67 |
| Image Forming*4) Performance | | | | | | | | | |
| I: (20° C., 65% RH) | good | good | good | Dm lowered, background | Dm lowered, background | Dm lowered, background | Dm lowered, background stain | Dm lowered, fine lines cut, background | Dm lowered, fine lines cut, background |

TABLE 10-continued

| | Example 29 | Example 30 | Example 31 | Comparative Example A-2 | Comparative Example B-2 | Comparative Example C-2 | Comparative Example D-2 | Comparative Example E-2 | Comparative Example F-2 |
|---|---|---|---|---|---|---|---|---|---|
| II: (30° C., 80% RH) | good | good | good | stain generated Dm lowered, background stain generated, fine line cut | stain generated Dm lowered, background stain generated, fine line cut | stain generated Dm lowered, background stain generated, find lines cut | slightly generated Dm lowered, background stain generated, fine lines cut | stain slightly generated Dm lowered, background stain generated, fine lines cut | stain slightly generated Dm lowered, background stain generated, fine lines cut |
| Contact Angle*5) with Water (°) | 10 or less | 10 or less | 10 or less | 10 or less | 10 or less | 10 or less | 10 or less | 10 or less | 10 or less |
| Printing Durability*6) | 8,000 prints | more than 10,000 prints | more than 10,000 prints | background stain occurred from the 1st print | background stain occurred from the 1st print | background stain occurred from the 1st print | background stain occurred from the 1st print | background stain occurred from the 1st print | background stain occurred from the 1st print |

The evaluation items shown in Table 10 above were conducted as follows.

*1) Smoothness of Photoconductive Layer

The smoothness (sec/cc) of each light-sensitive material was measured using a Beck Smoothness Test Machine (manufactured by Kumagaya Riko K.K.) under an air volume of 1 cc.

*2) Machanical Strength of Photoconductive Layer

The surface of each light-sensitive material was repeatedly rubbed with emery paper (#1000) under a load of 60 g/cm$^2$ using a Heidon 14 Model surface testing machine (manufactured by Shinto Kagaku K.K.). After removing abrasion dusts from the layer, the film retention (%) was determined from the weight loss of the photoconductive layer, which was employed as the mechanical strength of the layer.

*3) Electrostatic Characteristics

Each light-sensitive material was charged by applying thereto corona discharging of −6 kV for 20 seconds using a paper analyzer (Paper Analyzer Type SP-428, manufactured by Kawaguchi Denki K.K.) in the dark at 20° C., 65% RH and then allowed to stand for 10 seconds. The surface potential $V_{10}$ in this case was measured. Then, the sample was allowed to stand for 180 seconds in the dark and then the potential $V_{190}$ was measured. The dark decay retention [DRR (%)], i.e., the percent retention of potential after decaying for 180 seconds in the dark, was calculated from the following formula:

$$DRR\ (\%) = (V_{190}/V_{10}) \times 100$$

Also, the surface of the photoconductive layer was charged to −500 volts by corona discharging, then irradiated by monochromatic light of a wavelength of 785 n.m., the time required for decaying the surface potential $V_{10}$ to 1/10 thereof, and the exposure amount $E_{1/10}$ (erg/cm$^2$) was calculated therefrom.

Further, the surface of the photoconductive layer was charged to −500 volts by corona discharging, then irradiated by monochromatic light of a wavelength of 785 n.m., the time required for decaying the surface potential $V_{10}$ to 1/100 thereof, and the exposure amount $E_{1/100}$ (erg/cm$^2$) was calculated therefrom.

*4) Image Forming Performance

Each light-sensitive material was allowed to stand a whole day and night under the environmental condition (I) of 20° C., 65% RH or the environmental condition (II) of 30° C., 80% RH. Then, each sample was charged to −5 kV, exposed by scanning with a gallium-aluminum-arsenic semiconductor laser (oscillation wavelength 785 n.m.) of 2.8 mW in output as a light source at an exposure amount on the surface of 50 erg/cm$^2$, at a pitch of 25 μm, and a scanning speed of 330 m/sec., and developed using ELP-T (trade name, made by Fuji Photo Film Co., Ltd.) as a liquid developer followed by fixing. Then, the reproduced images (fog, image quality) were visually evaluated.

*5) Contact Angle with Water

Each light-sensitive material was passed once through an etching processor using a solution prepared by diluting an oil desensitizing solution ELP-EX (trade name, made by Fuji Photo Film Co., Ltd.) with twofold volume of distilled water to oil desensitized the surface of the photoconductive layer. Then, one drop of distilled water (2 μl) was placed on the surface, and the contact angle between the surface and the water drop formed thereon was measured using a goniometer.

*6) Printing Durability

Each light-sensitive material was processed in the same manner as described in *4) to form a toner image, the sample was oil-desensitized under the same condition as in *5) described above, and the printing plate thus prepared was mounted on an offset printing machine (Oliver Model 52, manufactured by Sakurai Seisakusho K.K.) as an offset master plate following by printing. Then, the number of prints obtained without causing background stains on the non-image area of prints and problems on the quality of the image area was employed as the printing durability. The larger the number of prints, the higher the printing durability.

As shown in Table 10, it can be seen that the light-sensitive material of this invention was excellent in the smoothness of the photoconductive layer, the film strength, and electrostatic characteristics as well as the reproduced images formed by processing had no background stains and had clear image quality. This is assumed to be based on that the binder resin suitably adsorbed on the photoconductive particles and suitably covered the surface of the particles. When the light-sensitive material was used as an offset master plate after processing, the photoconductive layer was sufficiently oil-desensitized by an oil-desensitizing solution for the same reason as above and the contact angle between the non-image area and water was as low as below 10 degrees, which showed that the layer was sufficiently rendered hydrophilic. At printing, no background stain of prints was observed.

On the other hand, each of the light-sensitive materials of Comparative Examples A-2 to F-2 show inferior electrostatic characteristics as compared with those of the light-sensitive materials of the present invention. In particular, $E_{1/100}$ values of Comparative Examples A-2 to F-2 are markedly higher than those of Examples. The $E_{1/100}$ value refers to the potential remaining in the non-image area (exposed area) after exposure in the image formation and, thus the lower the $E_{1/100}$ value, the lower the background stain in the non-image area after development.

Practically, it is necessary to reduce the residual potential ($V_R$) to $-10$ V or below. Thus, in the scanning exposure system using a semiconductor laser beam, the exposure amount required for reducing the residual potential to $-10$ V or below is a very important factor in designing an optical system of copying machines (cost of apparatus, precision of light pass in the optical system) so as to obtain $V_R$ of $-10$ V or below with an exposure amount as low as possible.

For the above reason, when an image was actually formed using an apparatus having a slightly lower irradiation amount, each of the light-sensitive materials of Comparative Examples A-2 to F-2 produced cutting of fine lines in the image area and background fog in the non-image area. Also, the material was used as an offset master plate, the light-sensitive materials of Comparative Examples A-2 to F-2 produced fog from the beginning of the print due to the fog in the non-image area, even under the printing conditions where the light-sensitive material of Example 2 according to the present invention could provide 8,000 prints of good quality.

The above results indicate that electrophotographic light-sensitive materials satisfying the electrostatic characteristics and the printing adaptability can be obtained only when the resin binder according to the present invention is used.

EXAMPLES 32 TO 40

Each of electrophotographic light-sensitive materials was prepared in the same manner as Example 29, except that 6.5 g of the resin (A) and 33.5 g of resin (C) shown in Table 11 below were used in place of the binder resin used in Example 29. The electrostatic characteristics and the printing property of the resulting light-sensitive material were measured in the same manner as Example 29. The results obtained are shown in Table 11 below.

TABLE 11

| | | Resin (B) | | | | | | | |
|---|---|---|---|---|---|---|---|---|---|
| Example | Resin (A) | No. | Chemical Structure | (Weight Ratio) | Weight Average Molecular Weight | $V_{10}$ (−V) | D.R.R. (%) | $E_{1/10}$ (erg/cm$^2$) | $E_{1/100}$ (erg/cm$^2$) |
| 32 | A-2 | C-2 | Methyl methacrylate/Ethyl methacrylate | (60/40) | $2.0 \times 10^5$ | 535 | 76 | 40 | 57 |
| 33 | A-3 | C-3 | Methyl methacrylate/Butyl methacrylate | (70/30 | $2.4 \times 10^5$ | 510 | 72 | 43 | 58 |
| 34 | A-4 | C-4 | Methyl methacrylate/Ethyl acrylate | (80/20) | $1.8 \times 10^5$ | 540 | 79 | 38 | 51 |
| 35 | A-5 | C-5 | Benzyl methacrylate | (100) | $3.6 \times 10^5$ | 490 | 73 | 36 | 55 |
| 36 | A-6 | C-6 | Phenyl methacrylate/Ethyl methacrylate | (80/20) | $2.2 \times 10^5$ | 590 | 85 | 39 | 50 |
| 37 | A-8 | C-7 | Styrene/Ethyl methacrylate | (20/80) | $1.8 \times 10^5$ | 575 | 83 | 37 | 50 |
| 38 | A-10 | C-8 | Butyl methacrylate/2,2,2-Trifluoroethyl methacrylate | (85/15) | $2.0 \times 10^5$ | 570 | 83 | 38 | 51 |
| 39 | A-21 | C-9 | Vinyltoluene/Propyl methacrylate | (25/75) | $1.5 \times 10^5$ | 580 | 83 | 37 | 50 |
| 40 | A-22 | C-10 | Styrene/Acrylonitrile/Butyl acrylate | (20/15/65) | $1.8 \times 10^5$ | 560 | 82 | 38 | 51 |

(The electrostatic characteristics were measured under the condition of 30° C., 80% RH.)

Also, when the light-sensitive material was used as an offset master plate, each of the plates provided more than 8,000 prints at printing.

The above results indicate that the light-sensitive material of the present invention is excellent in the smoothness of the photoconductive layer, film strength, electrophotographic properties and printing properties.

Further, it was found that electrophotographic properties can be improved by using the resin (A) having the repeating unit represented by the above formula (Ia) and/or (Ib), among the repeating units represented by formula (I).

EXAMPLES 41 TO 50

An electrophotographic light-sensitive material was prepared in the same manner as Example 29, except that 6 g of the resin (A-21) and 34 g of the resin (D) shown in Table 12 below were used in place of the binder resin used in Example 29, and that 0.019 g of Dye (II) having the following formula was used in place of 0.02 g of the cyanine dye (I) used in Example 29.

Dye (II):

-continued

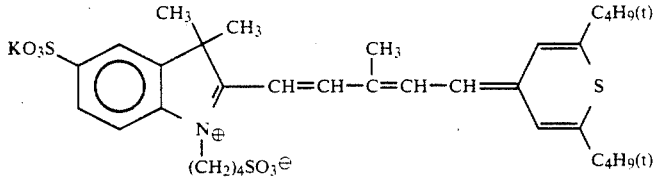

TABLE 12

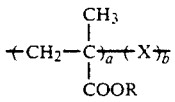

| Resin D | R | —X— | a/b(*) | Weight Average Molecular Weight |
|---|---|---|---|---|
| D-2 | $-C_2H_5$ | $\leftarrow CH_2-C(CH_3)(COOCH_2CH_2OH)\rightarrow$ | 96/4 | $12 \times 10^4$ |
| D-3 | " | $\leftarrow CH_2-C(CH_3)(COO(CH_2)_{10}OH)\rightarrow$ | 95/5 | $9.5 \times 10^4$ |
| D-4 | $-C_4H_9$ | $\leftarrow CH_2-C(CH_3)(CONHC(CH_2OH)_2-CH_3)\rightarrow$ | 98/2 | $10 \times 10^4$ |
| D-5 | " | $\leftarrow CH_2-C(CH_3)(CONH(CH_2)_{10}OH)\rightarrow$ | 97/3 | $11.5 \times 10^4$ |
| D-6 | " | $\leftarrow CH_2-CH\rightarrow$ (p-$CH_2OH$-C$_6H_4$) | 96/4 | $20 \times 10^4$ |
| D-7 | $-C_2H_5$ | $\leftarrow CH_2-C(CH_3)(COO(CH_2)_2N(CH_3)_2)\rightarrow$ | 95/5 | $8.8 \times 10^4$ |
| D-8 | $-C_3H_7$ | $\leftarrow CH_2-C(CH_3)(COO(CH_2)_2N(CH_3)(C_6H_5))\rightarrow$ | 95/5 | $9.5 \times 10^4$ |
| D-9 | $-C_4H_9$ | $\leftarrow CH_2-CH\rightarrow$ (p-$CH_2N(CH_3)_2$-C$_6H_4$) | 96/4 | $10.5 \times 10^4$ |

TABLE 12-continued

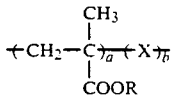

| Resin D | R | —X— | a/b(*) | Weight Average Molecular Weight |
|---|---|---|---|---|
| D-10 | $-C_2H_5$ | $\leftarrow CH_2-CH\rightarrow$ 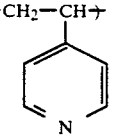 | 97/3 | $10.5 \times 10^4$ |
| D-11 | $-C_4H_9$ | $\leftarrow CH_2-C(CH_3)(COO(CH_2)_2N)\rightarrow$ 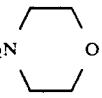 | 95/5 | $13 \times 10^4$ |

*weight ratio

The electrostatic characteristics, the image forming performance and the printing properties of each of the above light-sensitive materials were measured, and the results obtained are shown in Table 13 below.

TABLE 13

| Example | Resin (D) | $V_{10}$ (−V) | D.R.R. | $E_{1/10}$ (erg/cm$^2$) | Image Forming Performance (30° C., 80% RH) | Printing Durability (Sheets) |
|---|---|---|---|---|---|---|
| 41 | D-2 | 570 | 84 | 48 | Good | 9000 |
| 42 | D-3 | 575 | 86 | 46 | " | " |
| 43 | D-4 | 550 | 80 | 49 | " | 10000 |
| 44 | D-5 | 565 | 82 | 50 | " | " |
| 45 | D-6 | 550 | 80 | 44 | " | 9000 |
| 46 | D-7 | 545 | 78 | 48 | " | " |
| 47 | D-8 | 555 | 79 | 46 | " | " |
| 48 | D-9 | 540 | 78 | 45 | " | " |
| 49 | D-10 | 545 | 78 | 43 | " | " |
| 50 | D-11 | 540 | 77 | 43 | " | " |

(The electrostatic characteristics were determined under the condition of 30° C., 80% RH.)

As is shown in Table 13, the light-sensitive material of the present invention was excellent in the electrostatic charging property, dark charge retentivity and photosensitivity, and provided clear reproduced images having no background fog even under high-temperature high-humidity condition (30° C., 80%RH). Also, when the light-sensitive material was used for printing as an offset master plate after processing, 9,000 to 10,000 prints of clear images having no background fog could be obtained.

EXAMPLES 51 TO 62

A mixture of 6 g of the resin (A-9), 34 g of each of the resin (E) shown in Table 14 below, 0.015 g of Cyanine Dye (III) having the following formula, 0.15 g of maleic anhydride, 200 g of zinc oxide and 300 g of toluene was dispersed in a ball mill for 4 hours to prepare a coating composition for a photoconductive layer. Each of the electrophotographic light-sensitive materials was prepared from the above composition in the same manner as Example 29.

Cyanine Dye (III):

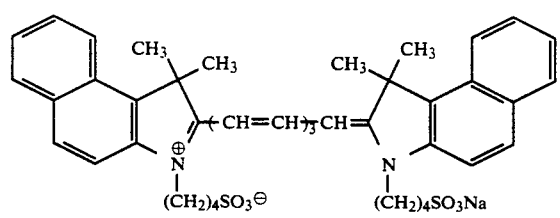

TABLE 14

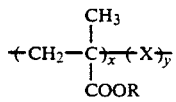

| Example | Resin (E) | R | —X— | x/y (*) | Weight Average Molecular Weight |
|---|---|---|---|---|---|
| 51 | E-2 | $-C_2H_5$ | $\leftarrow CH_2-CH(COOH)\rightarrow$ | 99.5/0.5 | $1.8 \times 10^5$ |

TABLE 14-continued
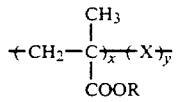
| Example | Resin (E) | R | —X— | x/y (*) | Weight Average Molecular Weight |
|---|---|---|---|---|---|
| 52 | E-3 | " | 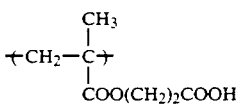 | 99.5/0.5 | $2.0 \times 10^5$ |
| 53 | E-4 | " | 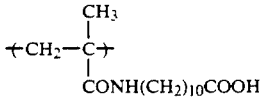 | 99.2/0.8 | $2.1 \times 10^5$ |
| 54 | E-5 | $-C_4H_9$ | 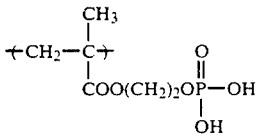 | 99.7/0.3 | $2.5 \times 10^5$ |
| 55 | E-6 | $-C_4H_9$ | 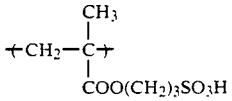 | 99.7/0.3 | $1.5 \times 10^5$ |
| 56 | E-7 | $-C_2H_5$ | 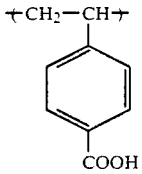 | 99.5/0.5 | $1.1 \times 10^5$ |
| 57 | E-8 | $-CH_2C_6H_5$ | 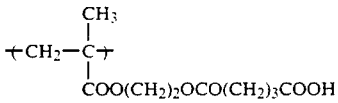 | 99.4/0.6 | $2.1 \times 10^5$ |
| 58 | E-9 | $-C_3H_7$ | 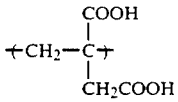 | 99.7/0.3 | $2.2 \times 10^5$ |
| 59 | E-10 | $-C_4H_9$ | 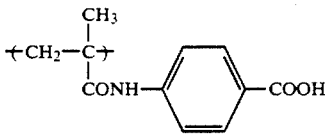 | 99.5/0.5 | $2.0 \times 10^5$ |
| 60 | E-11 | $-C_3H_7$ | 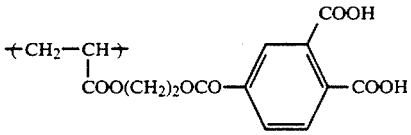 | 99.7/0.3 | $2.1 \times 10^5$ |
| 61 | E-12 | $-C_2H_5$ | 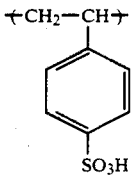 | 99.7/0.3 | $1.6 \times 10^5$ |

TABLE 14-continued

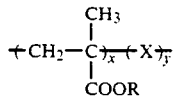

| Example | Resin (E) | R | —X— | x/y (*) | Weight Average Molecular Weight |
|---|---|---|---|---|---|
| 62 | E-13 | $-C_2H_5$ | $\leftarrow CH_2-C\rightarrow$ (COO(CH₂)₂COOH) | 99.4/0.6 | $2.2 \times 10^5$ |

(*) Weight Ratio

Each of the light-sensitive materials prepared above showed the following excellent properties even under severe conditions of high-temperature and high-humidity (30° C., 80% RH):

$V_{10}$: −580 to −590 (V)

D.R.R.: 83 to 86%

$E_{1/10}$: 30 to 33 erg/cm$^2$ $E_{1/100}$: 38 to 42 erg/cm$^2$

Also, the reproduced image showed a clear image having no background fog and no cutting of fine lines even under severe conditions of high-temperature and high-humidity (30° C., 80% RH). Further, when the light-sensitive material was used for printing as an offset master plate after processing, 10,000 prints of clear images having no background stain could be obtained.

EXAMPLE 63 AND COMPARATIVE EXAMPLE G-2

EXAMPLE 63

A mixture of 6 g of the resin (A-8), 34 g of the resin (D-1), 200 g of zinc oxide, 0.02 g of uranine, 0.04 g of Rose Bengal, 0.03 g of bromophenol blue, 0.20 g of phthalic anhydride and 300 g of toluene was dispersed in a ball mill for 4 hours. The dispersion was coated on a paper, which had been subjected to an electroconductive treatment, by a wire bar in a dry coating amount of 22 g/m$^2$ and dried for 1 minute at 110° C. The coated product was allowed to stand for 24 hours in the dark under conditions of 20° C., 65% RH to obtain an electrophotographic light-sensitive material.

Comparative Example G-2

An electrophotographic light-sensitive material was prepared in the same manner as Example 63, except that 6 g of Resin (R-2) and 34 g of Resin (D-1) were used in place of the resin binder used in Example 63.

The properties of the resulting light-sensitive materials were measured in the same manner as Example 29, and the results obtained are shown in Table 15 below.

TABLE 15

| | Example 63 | Comparative Example G-2 |
|---|---|---|
| Binder Resin | (A-2)/(C-2) | (R-2)/(D-1) |
| Smoothness of Photoconductive Layer (sec/cc) | 145 | 140 |
| Strength of Photoconductive Layer (%) | 98 | 97 |
| Electrostatic Characteristics*8) | | |
| $V_{10}$ (-V) | | |
| I (20° C., 65% RH) | 565 | 540 |
| II (30° C., 80% RH) | 560 | 530 |
| D.R.R. (%) | | |
| I (20° C., 65% RH) | 96 | 90 |
| II (30° C., 80% RH) | 94 | 86 |
| $E_{1/10}$ (lux · sec) | | |
| I (20° C., 65% RH) | 9.3 | 13.0 |
| II (30° C., 80% RH) | 10.3 | 17.5 |
| $E_{1/100}$ (lux · sec) | | |
| I (20° C., 65% RH) | 28 | 48 |
| II (30° C., 80% RH) | 30 | 53 |
| Imaging Forming Performance*8) | | |
| I (20° C., 65% RH) | good | edge marks of pasted-up portion appeared |
| II (30° C., 80% RH) | good | edge marks of pasted-up portion appeared significantly |
| Contact Angle with Water (°) | 10 or less | 10 or less |
| Printing Durability | 10,000 prints | Edge marks of pasted-up portion appeared as background stains from the beginning of printing |

The above measurements were conducted by the same procedures as described in Example 29, except that the electrostatic characteristics and the image forming performance were determined in the following manner.

*7) Electrostatic Characteristics $E_{1/10}$ and $E_{1/100}$

After charging the surface of the photoconductive layer to −400 volts by corona discharge, the surface of the photoconductive layer was exposed to visible light of 2.0 lux, the time required for decaying the surface potential $V_{10}$ to 1/10 and 1/100 was determined, and the exposure amounts $E_{1/10}$ and $E_{1/100}$ (lux·sec), respectively, were calculated therefrom.

*8) Image Forming Performance

Each of the light-sensitive materials was allowed to stand one day, and the material was processed by a full-automatic plate-making machine EPL-404V (trade name, made by Fuji Photo Film Co., Ltd.) using EPL-T (trade name, made by Fuji Photo Film Co., Ltd.) as a toner. Then, the reproduced image were visually evaluated for fog and image quality. In this case, the image formtion was conducted under the environmental condition (I) of 20° C., 65% RH and environmental condition (II) of 30° C., 80% RH. The original used for image formation also contained a cut-and-pasted up portion from a different original.

In these light-sensitive materials, no difference was noted in the smoothness and the strength of the photoconductive layer. However, in the electrostatic characteristics, Comparative Example G-2 showed particularly high exposure amount in $E_{1/100}$, and this amount significantly increased at high temperature and high-humidity. On the other hand, the electrostatic characteristics of the light-sensitive material according to the present invention were found to be satisfactory.

In the actual image forming performance, Comparative Example G-2 showed a frame of the cut-and-pasted up portion (i.e., edge marks of the cut-and-pasted up portions) as background stains in the non-image area, whereas, the light-sensitive material according to the present invention showed a clear image having no such background stains.

When the light-sensitive material was used as an offset master plate after oil-desensitizing treatment, the plate of the present invention provided 10,000 prints having a clear image free from background stains, whereas, in the plate produced from the light-sensitive material of Comparative Example G-2, the above edge marks in the cut-and-pasted up portion were not removed after oil-desensitizing treatment, and the marks were generated in prints from the beginning of the printing.

From the above results, it is noted that only the light-sensitive material of the present invention provide satisfactory results.

EXAMPLES 64 TO 81

Each of the light-sensitive materials was prepared in the same manner as Example 63, except that 6.5 g of the resin (A) and 33.5 g of the resin (C), (D) or (E) shown in Table 16 below were used in place of 6 g of the resin (A-8) and 34 g of the resin (D-1).

TABLE 16

| Example | Resin (A) | Resin (C), (D) or (E) |
|---|---|---|
| 64 | A-1 | C-2 |
| 65 | A-4 | C-7 |
| 66 | A-5 | C-10 |
| 67 | A-7 | D-2 |
| 68 | A-8 | D-4 |
| 69 | A-10 | D-6 |
| 70 | A-11 | D-7 |
| 71 | A-21 | D-9 |
| 72 | A-24 | D-10 |
| 73 | A-25 | D-11 |
| 74 | A-2 | E-4 |
| 75 | A-25 | E-5 |
| 76 | A-6 | E-6 |
| 77 | A-7 | E-9 |
| 78 | A-8 | E-11 |
| 79 | A-3 | E-12 |
| 80 | A-11 | E-8 |
| 81 | A-20 | E-10 |

The light-sensitive materials of this invention were excellent in the charging property, dark change retentivity, and light-sensitivity and provided clear images having neither background stains nor fine line cutting under severe conditions (30° C., 80% RH) at practical imaging.

When each master plate was used as an offset master plate for printing, more than 8,000 prints having clear images and no background fog could be obtained.

EXAMPLES 82 AND 83

A mixture of 6.5 g of the resin (A-23) (Example 82) or the resin (A-15) (Example 83), 33.5 g of the resin (C-2), 200 g of zinc oxide, 0.02 g of uranine, 0.04 g of Rose Bengal, 0.03 g of bromophenol blue, 0.20 g of phthalic anhydride and 300 g of toluene was dispersed in a ball mill for 3 hours. Then, to the dispersion was added 0.6 g of glutaric acid (Example 82) or 0.5 g of 1,6-hexanediol (Example 83), and the mixture was dispersed in a ball mill for 10 minutes.

The dispersion was coated on a paper which had been subjected to an electroconductive treatment by a wire bar in a dry coating amount of 20 g/m$^2$ and dried for 1 minutes at 120° C. and then for 1.5 hours at 120° C. Then, the coated product was allowed to stand for 24 hours under the condition of 20° C., 65% RH to obtain an electrophotographic light-sensitive material.

The resulting light-sensitive materials were evaluated for the electrostatic characteristics and the image forming performance and found to have satisfactory performance.

Also, when each of the light-sensitive materials was used as an offset master plate, more than 10,000 prints could be obtained even when the resin (C) was used. It is considered that the above good results are obtained by an improvement in the film strength by crosslinking of curable groups in the resin (A) by heat-treatment after film forming.

According to the present invention, an electrophotographic light-sensitive material having excellent electrostatic characteristics (in particular under severe conditions) and having clear images of good quality can be obtained. In particular, the light-sensitive material is useful for scanning exposure system using a semiconductor laser beam.

The electrostatic characteristics can be further improved by using a repeating unit containing a specific methacrylate component represented by formula (Ia) or (Ib) in the resin (A) of the present invention.

Furthermore, the mechanical strength of the electrophotographic light-sensitive material can be increased by incorporating heat- and/or photo-curable functional groups in the resin (A) of the present invention.

Also, the mechanical strength of the electrophotographic light-sensitive material can be increased by using a heat- and/or photo-curable resin and/or a crosslinking agent in combination with the resin (A).

Further, the mechanical strength of the electrophotographic light-sensitive material can be increased by using a specific resin having a weight average molecular weight of from $5\times10^4$ to $5\times10^5$ in combination with the resin (A).

While the invention has been described in detail and with reference to specific embodiments thereof, it will be apparent to one skilled in the art that various changes and modifications can be made therein without departing from the spirit and scope thereof.

What is claimed is:

1. A process for producing an electrophotographic light-sensitive material comprising a support having provided thereon a photoconductive layer containing an inorganic photoconductive substance and a binder resin, which comprises mixing the inorganic photoconductive substance and the binder resin to prepare a dispersion for forming the photoconductive layer, and coating the dispersion on the support, wherein said binder resin contains at least one resin (A) which has a weight average molecular weight of from $1\times10^3$ to $1\times10^4$ contains a repeating unit represented by the formula (I) shown below as a polymer component, has a crosslinked structure prior to the preparation of the dispersion for forming the photoconductive layer, and has at least one acidic group selected from a $—PO_3H_2$ group, a $—SO_3H$ group, a —COOH group, a

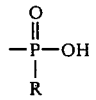

group
(wherein R represents a hydrocarbon group or a —OR' group (wherein R' represents a hydrocarbon group)) and a cyclic acid anhydride-containing group bonded at only one terminal of at least one polymer main chain:

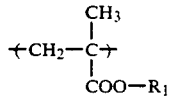

(I)

wherein $R_1$ represents a hydrocarbon group.

2. A process for producing an electrophotographic light-sensitive material as claimed in claim 1, wherein said polymer component corresponding to the repeating unit represented by formula (I) contains at least 30% by weight of at least one of the repeating units represented by the formula (Ia) and (Ib) shown below:

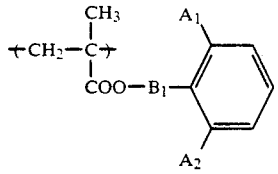

(Ia)

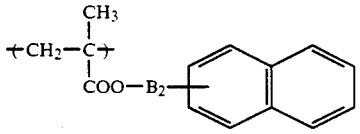

(Ib)

wherein $A_1$ and $A_2$, which may be the same or different, each represents a hydrogen atom, a hydrocarbon group having from 1 to 10 carbon atoms, a chlorine atom, a bromine atom, a $—COR_3$ group or a $—COOR_3$ group wherein $R_3$ represents a hydrocarbon group having from 1 to 10 carbon atoms, and $B_1$ and $B_2$, which may be the same or different, each represents a single bond or a linkage group having from 1 to 4 linking atoms which connects between —COO— and the benzene ring.

3. A process for producing an electrophotographic light-sensitive material as claimed in claim 1, wherein said resin (A) further contains from 1 to 30% by weight of a repeating unit containing a heat- and/or photo-curable functional group.

4. A process for producing an electrophotographic light-sensitive material as claimed in claim 2, wherein said resin (A) further contains from 1 to 30% by weight of a repeating unit containing a heat- and/or photo-curable functional group.

5. A process for producing an electrophotographic light-sensitive material as claimed in claim 1, wherein said binder resin further contains at least one heat- and/or photo-curable resin (B), in addition to said resin (A).

6. A process for producing an electrophotographic light-sensitive material as claimed in claim 2, wherein said binder resin further contains at least one heat- and/or photo-curable resin (B), in addition to said resin (A).

7. A process for producing an electrophotographic light-sensitive material as claimed in claim 3, wherein said binder resin further contains at least one heat- and/or photo-curable resin (B), in addition to said resin (A).

8. A process for producing an electrophotographic light-sensitive material as claimed in claim 4, wherein said binder resin further contains at least one heat- and/or photo-curable resin (B), in addition to said resin (A).

9. A process for producing an electrophotographic light-sensitive material as claimed in claim 3, wherein said binder resin further contains at least one crosslinking agent, in addition to said resin (A).

10. A process for producing an electrophotographic light-sensitive material as claimed in claim 5, wherein said binder resin further contains at least one crosslinking agent, in addition to said resin (A).

11. A process for producing an electrophotographic light-sensitive material as claimed in claim 1, wherein said binder resin further contains a resin (C) having a weight average molecular weight of from $5\times10^4$ to $5\times10^5$ and does not contain a $—PO_3H_2$ group, a $—SO_3H$ group, a —COOH group, a

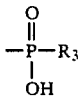

(wherein $R_3$ represents a hydrocarbon group or a $—OR_4$ group (wherein $R_4$ represents a hydrocarbon group)) or a basic group, in addition to the resin (A).

12. A process for producing an electrophotographic light-sensitive material as claimed in claim 1, wherein said binder resin further contains at least one resin (D) having a weight average molecular weight of from $5\times10^4$ to $5\times10^5$ and containing from 0.1 to 15% by weight of a copolymer component containing at least one functional group selected from a —OH group and a basic group, in addition to the resin (A).

13. A process for producing an electrophotographic light-sensitive material as claimed in claim 1, wherein said binder resin further contains, in addition to the resin (A), (1) at least one resin (E) having a weight average molecular weight of from $5\times10^4$ to $5\times10^5$ and containing a copolymer component containing the acidic group in an amount of 50% or below of the acidic group content contained in the resin (A) used, or (2) at least one resin (E) having a weight average molecular weight of from $5\times10^4$ to $5\times10^5$ and containing a copolymer component containing an acidic group which has a higher pKa value than that of the acidic group contained in said resin (A) and which is selected from a $—PO_3H_2$ group, a $—SO_3H$ group, a —COOH group and a

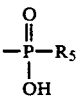

(wherein $R_5$ represents a hydrocarbon group or a $—OR_6$ group (wherein $R_6$ represents a hydrocarbon group)).

* * * * *